US005443251A

United States Patent [19]

Kan et al.

[11] Patent Number: 5,443,251

[45] Date of Patent: Aug. 22, 1995

[54] SHEET FEEDING APPARATUS

[75] Inventors: Shoichi Kan, Yokohama; Tomoyuki Araki, Tokyo, both of Japan

[73] Assignee: Canon Kabushiki Kaisha, Tokyo, Japan

[21] Appl. No.: 281,155

[22] Filed: Jul. 27, 1994

Related U.S. Application Data

[63] Continuation of Ser. No. 855,497, Mar. 23, 1992, abandoned, which is a continuation of Ser. No. 490,461, Mar. 8, 1990, abandoned.

[30] Foreign Application Priority Data

| | | | |
|---|---|---|---|
| Mar. 8, 1989 | [JP] | Japan | 1-057309 |
| Jun. 8, 1989 | [JP] | Japan | 1-145679 |
| Jun. 8, 1989 | [JP] | Japan | 1-145680 |
| Sep. 14, 1989 | [JP] | Japan | 1-239321 |

[51] Int. Cl.[6] ..... B65H 3/42

[52] U.S. Cl. ..... 271/16; 271/22; 271/24; 271/124; 271/167; 271/169; 271/170

[58] Field of Search ..... 271/16, 21, 22, 24, 271/121, 124, 167, 169, 170

[56] References Cited

U.S. PATENT DOCUMENTS

| | | | |
|---|---|---|---|
| 1,919,238 | 7/1933 | McCarthy | 271/124 X |
| 4,364,551 | 12/1982 | Rutishauser | 271/121 |
| 4,623,138 | 11/1986 | Sakamaki | 271/170 |
| 4,647,030 | 3/1987 | Tomita | 271/22 |
| 4,828,245 | 5/1989 | Shimogawara | 271/170 X |
| 5,026,042 | 6/1991 | Miller | 271/121 X |

FOREIGN PATENT DOCUMENTS

| | | | |
|---|---|---|---|
| 0279402 | 8/1988 | European Pat. Off. . | |
| 202228 | 11/1983 | Japan | 271/167 |
| 2187716 | 9/1987 | United Kingdom . | |

OTHER PUBLICATIONS

European Search Report (3 pgs.).

*Primary Examiner*—H. Grant Skaggs
*Assistant Examiner*—Carol L. Druzbick
*Attorney, Agent, or Firm*—Fitzpatrick, Cella, Harper & Scinto

[57] ABSTRACT

The present invention provides a sheet feeding apparatus comprising a supply means contacting one of the sheet in a sheet stack, for applying a feeding force to the sheet; a first limiting means abutting against a front end of the sheet stack in a sheet feeding direction, for limiting the movement of the sheet stack in the sheet feeding direction; a second limiting means contacting the sheet to which the feeding force is applied from the supply means, for limiting the movement of the sheet stack in a sheet thickness direction; and a clearance defined between the first and second limiting means, the clearance having a predetermined length in the sheet feeding direction.

24 Claims, 19 Drawing Sheets

SHEET FEEDING APPARATUS

This application is a continuation, of application Ser. No. 07/855,497, filed Mar. 23, 1992, now abandoned, which is a continuation of application Ser. No. 07/490,461, filed on Mar. 8, 1990, now abandoned.

BACKGROUND OF THE INVENTION

1. Field of the Invention

The present invention relates to a sheet feeding apparatus for feeding a sheet separated from a sheet stack one by one.

The sheet is used in office equipment such as copying machines, printers, recording machines and the like and is a cut sheet such as a transfer sheet, photo-sensitive sheet, heat-sensitive sheet, electrostatic recording sheet, printing sheet, original, card, envelope and the like, and is fed to the office equipment. The material of the sheet is not limited to "paper".

2. Related Background Art

Generally, in a sheet feeding apparatus used with the office equipment such as a copying machine, sheets such as transfer papers and photosensitive papers are stacked on sheet support plates disposed within a cassette or a deck, and the sheet is separated from the sheet stack one by one to be fed successively by means of a sheet supply means such as sheet supply rollers.

In order to prevent the double-feeding of the sheets, it is known to provide separating claws or pawls arranged in front of a leading end of the sheet stack in a sheet feeding direction, whereby, when an uppermost sheet is desired to be fed, a bent loop is formed in the front part of the uppermost sheet so that only the uppermost sheet is separated and fed by riding it over the separating claws (separating claw system).

FIG. 31 shows a perspective view of an example of a main portion of the conventional separating claw system.

Referring to FIG. 31, the reference numeral 100 designates sheet support plates on which sheets (cut sheets and the like) P having a predetermined size are stacked; 101 designates bias springs for biasing the sheet support plates upwardly; 102 designates supply rollers; and 103 designates a pair of left and right separating claws engaging the upper surface of the left and right corners of a leading end of the sheet stack P.

The upper surface of the sheet stack P is pressed at its front portion, against the supply rollers 102 at a predetermined urging pressure by the upward bias forces of the bias springs 101 for lifting the sheet support plates. Alternatively, the supply rollers may be lowered to urge the upper surface of the sheet stack P at a predetermined pressure in response to each sheet feed signal.

Each separating claw 103 is pivotably mounted on a pivot 103*a* and rests on the upper surface of the corresponding front corner of the sheet stack P with its own weight.

When the supply rollers 102 are rotated in the sheet feeding direction, the uppermost sheet $P_1$ on the sheet stack P is subjected to a feeding force toward the sheet feeding direction by the friction force between it and the supply rollers. Although the uppermost sheet $P_1$ tends to move forwardly by the feeding force, since the left and right corners of the front end of the sheet $P_1$ are restrained by the separating claws 103, the sheet $P_1$ cannot be moved. As a result, as the supply rollers 102 are rotated, a bent loop A is formed in the uppermost sheet $P_1$ between the separating claws 103 and the supply rollers 102 in opposition to the hardness (of the sheet material) to be bent.

When the bent loop A grows up to a certain level, the left and right :corners of the uppermost sheet $P_1$ pressed down by the respective separating claws 103 are automatically moved from the undersides of the separating claws to the uppersides thereof to ride over the separating claws by the restoring force of the sheet tending to varnish the loop. In this way, only the uppermost sheet $P_1$ is released from the restraining force of the separating claws and is separated from the remaining sheet stack P to be fed (as shown by the two-dot chain line).

In such a sheet feeding apparatus having the separating claws system, if the sheets to be separated and fed one by one comprise thicker sheets (having the hardness to be bent stronger than that of a normal or plain sheet) such as postcards, library cards or envelopes, the above-mentioned bent loop A is not or almost not formed in the sheet between the separating claws 103 and the supply rollers 102 because the resistance to bending (stiffness and/or elasticity of the sheet) overcomes the feeding force of the supply rollers 102. Consequently, the uppermost thicker sheet cannot ride over the separating claws, thus causing the impossible or insufficient separation of only the uppermost sheet from the remaining sheet stack. If the stronger feeding force is applied to the thicker sheet to try to separate the latter from the sheet stack, the front corners of the thicker sheet are bent or folded while the latter rides over the separating claws, which would result in the jamming of the sheet or malfunction of the sheet feeding apparatus.

To solve the above-mentioned drawback, sheet feeding apparatuses having retard rollers for handling the thicker sheets nave been proposed. Such apparatuses, however, were very expensive and complicated.

SUMMARY OF THE INVENTION

The present invention is directed to solve the above-mentioned conventional drawback, and an object of the present invention is to provide a sheet feeding apparatus which can effectively separate and feed a thicker sheet without the complicated arrangement.

In order to achieve the above object, the present invention provides a sheet feeding apparatus comprising a supply means for applying a feeding force to an uppermost sheet in a sheet stack by engaging with the uppermost sheet, a first limiting means for limiting the movement of the sheet stack toward a sheet feeding direction by abutting against a front end of the sheet stack in the sheet feeding direction, and a second limiting means for limiting the position of the sheet stack in an up-and-down direction by engaging with an upper surface of the sheet stack, and wherein a clearance $\alpha$ directed to a direction perpendicular to the sheet feeding direction is provided between an uppermost end of the first limiting means and a sheet engaging surface of the second limiting means, the clearance $\alpha$ being smaller than a thickness of a single sheet included in the sheet stack.

Further, the present invention is characterized in that the first limiting means has an upper inclined portion inclined toward the sheet feeding direction; that the second limiting means limits the position of the sheet stack in the up-and-down direction at a portion thereof rearwardly of the front end of the sheet stack; that there is a clearance $\beta$ directed along the sheet feeding direction between the uppermost end of the first limiting means and the sheet engaging surface of the second limiting means, the clearance $\beta$ being set to have a value of 2–10 mm; and that, when the coefficient of friction of a portion of the upper inclined portion of the first limiting means which engages with the uppermost sheet is $\mu_1$ and the coefficient of friction of the remaining portion of the upper inclined portion which engages with other sheets in the sheet stack is $\mu_2$, the relation $\mu_1 < \mu_2$ is established.

With the arrangement as mentioned above, when the sheet feeding force is applied to the uppermost sheet in the sheet stack, the front or leading end of the uppermost sheet rides over the first limiting means to be released from the first limiting means, whereby the uppermost sheet is fed through the clearance (gate) between the first and second limiting means. In this case, if the next and other sheets are moved together with the uppermost sheet due to the friction between the uppermost sheet and the next sheet, since the front ends of the next and other sheets are abutted against the first limiting means so that these sheets cannot ride over the first limiting means by the friction force between the uppermost sheet and the next sheet, the double-feeding wherein the next and other sheets are fed together with the uppermost sheet can be effectively prevented.

That is to say, in the present invention, unlike to the conventional separating claw system that the uppermost sheet is separated from the sheet stack and fed by forming the bent loop in the uppermost sheet, since only the uppermost sheet is past through the clearance (gate) between the first and second limiting means by applying the sheet feeding force to the uppermost sheet to separate and feed only the uppermost sheet, even the thicker sheets which have the stronger hardness to be bent and are not suitable to be separated by the conventional separating claw system can be effectively and reliably separated and fed with a simple construction.

Since the first limiting means has the upper inclined portion inclined toward the sheet feeding direction, the uppermost sheet can easily and smoothly ride over the first limiting means by slidingly guiding the front end of the uppermost sheet upwardly along the upper inclined portion by the sheet feeding force applied to the uppermost sheet.

Since the coefficients of friction on the upper inclined portion are partially different ($\mu_1 < \mu_2$), the front end of the uppermost sheet can smoothly ride over the first limiting means, and the front ends of second and other sheets are positively trapped by the first limiting means to prevent these sheets from riding over the first limiting means together with the uppermost sheet, thus avoiding the double-feeding of the sheets.

Further, by providing the clearance B along the sheet feeding direction, the range of the thickness of the separable sheet is expanded, and even sheet having folded portions, sheets having wrinkled surfaces such as envelopes and sheets having uneven thickness can be positively separated.

DETAILED DESCRIPTION OF THE PREFERRED EMBODIMENTS

The present invention will now be explained in connection with embodiments thereof with reference to the accompanying drawings.

First of all, a first embodiment of the present invention will be explained with reference to FIGS. 1 to 4.

Figure 1:
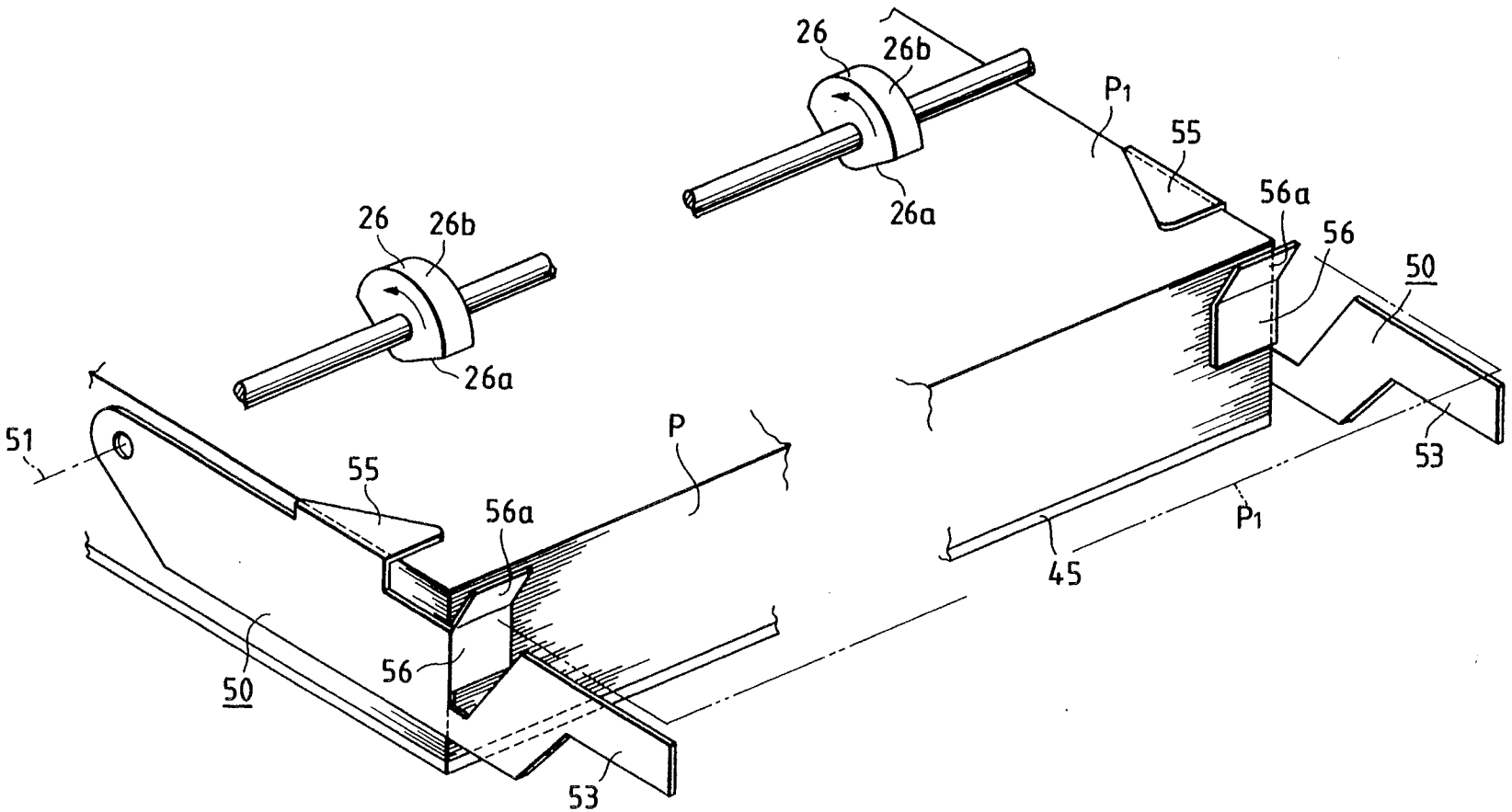
FIG. 1 is a perspective view of a main portion of a sheet feeding apparatus according to a first embodiment of the present invention.

In FIG. 1, the reference numeral 45 denotes sheet support plates which are biased upwardly by means of corresponding bias means (not shown); P denotes sheets (sheet stack) stacked on the support plates 45; and 26 denotes sheet supply rollers positioned above the sheet stack P. Each supply roller 26 has an arcuate profile including an arcuate portion 26*b* and a chord portion 26*a* and is normally held in a waiting position where the chord portion 26*a* faces downwardly toward the sheet stack without contacting it. When the supply rollers 26 are rotated by one revolution in a sheet feeding direction, the arcuate or cylindrical portions 26*a* of the rollers are contacted with the upper surface of the sheet stack, thereby applying a feeding force due to a friction force in the sheet feeding direction to an uppermost sheet $P_1$ in the sheet stack P.

The reference numeral 50 denotes a pair of left and right sheet separating levers which are pivotably mounted on side walls (not shown) arranged on both sides of the support plates 45 for pivotal movement around respective axes 51. Each of the sheet separating levers 50 includes a first limiting portion (front end limiting member) 56 for limiting the movement of the sheet stack P in the sheet feeding direction by abutting against a front end (leading end with respect to the sheet feeding direction) of the sheet stack P, and a second limiting portion (height limiting member) 55 for limiting the movement of the sheet stack P in an up-and-down direction by abutting against the upper surface of the sheet stack P. In the free condition, the left and right sheet separating levers 50 tend to rotate downwardly with their own weights and are positioned in such a way that the height limiting members 55 thereof rest on the upper surface of the sheet stack P at positions near front end corners of the sheet stack. Further, the front end limiting members 56 are positioned in confronting relation to the front faces of the front end corners of the sheet stack P.

Figure 2:
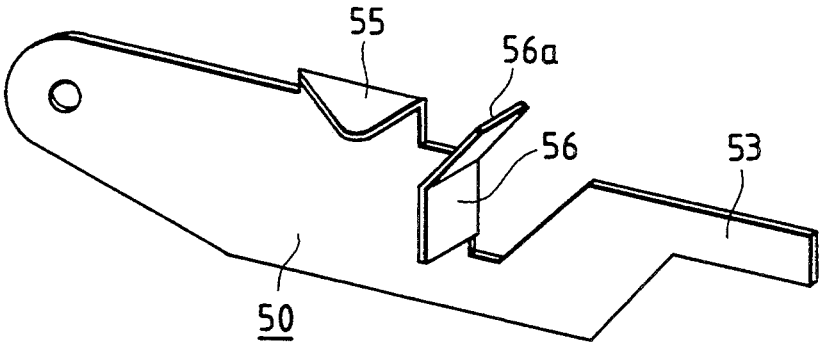
FIG. 2 is a perspective view of a sheet separating lever.
Figure 3:
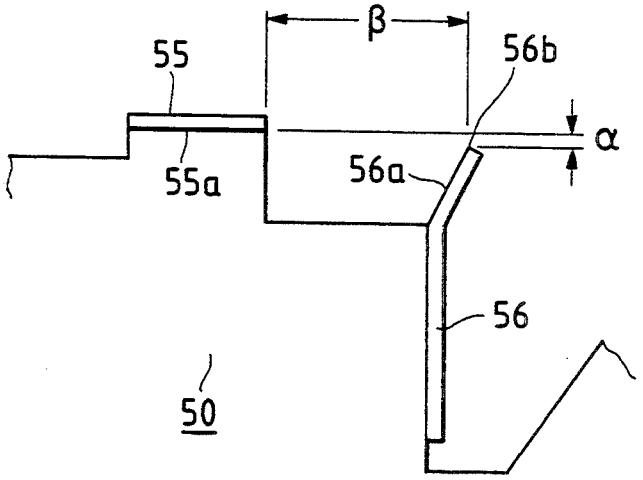
FIG. 3 is a side view of a main portion of the sheet separating lever.

FIG. 2 is a perspective view of the right sheet separating lever 50, and FIG. 3 is an enlarged view showing the front end limiting member 56 and the height limiting member 55 of the sheet separating lever.

In the illustrated embodiment, the height limiting member 55 acts to limit the movement of the sheet stack P in the up-and-down direction at a position rearwardly of the front end of the sheet stack P. The front end limiting member 56 has an upper inclined portion 56*a* inclined upwardly and forwardly toward the sheet feeding direction. Between an uppermost end 56*b* (FIG. 3) of the front end limiting member 56 (over which the sheet passes) and a sheet engaging surface (undersurface) 55*a* of the height limiting member 55, there is provided a clearance G directed to a direction perpendicular to the sheet feeding direction, which clearance $\alpha$ is selected to have a value smaller than a thickness of a single sheet included in the sheet stack P (Incidentally, the clearance may be omitted). Further, between the uppermost end 56*b* of the front end limiting member 56 and a front edge of the sheet engaging surface 55*a* of the height limiting member 55, there is provided a clearance $\beta$ directed along the sheet feeding direction, which clearance B is selected to have a value of 2–10 mm.

Next, processes that only a single sheet is separated by the sheet feeding apparatus having the above-mentioned construction will be now explained with reference to FIG. 4.

Figure 4A:
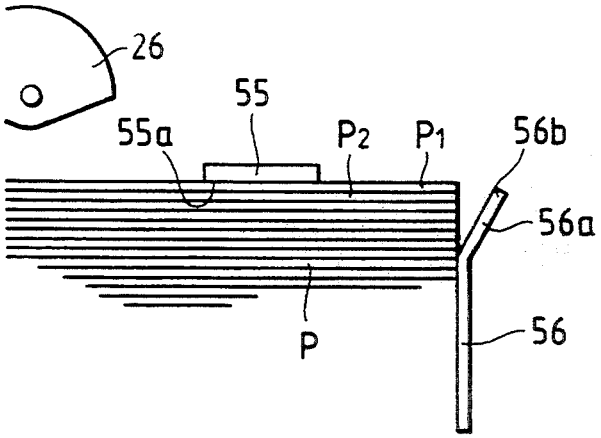
FIGS. 4A, 4B and 4C are explanatory views showing processes that only a single sheet is separated from the other sheets.
Figure 4B:
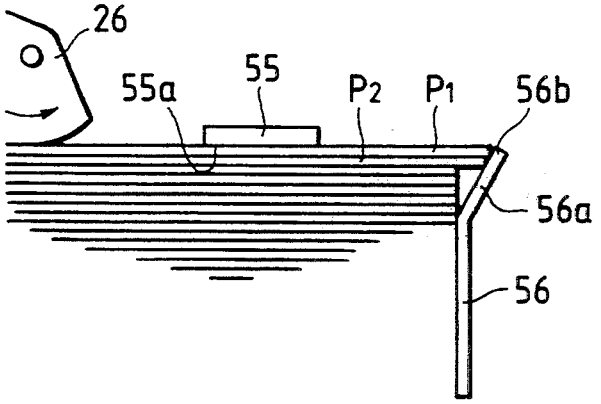
Figure 4C:
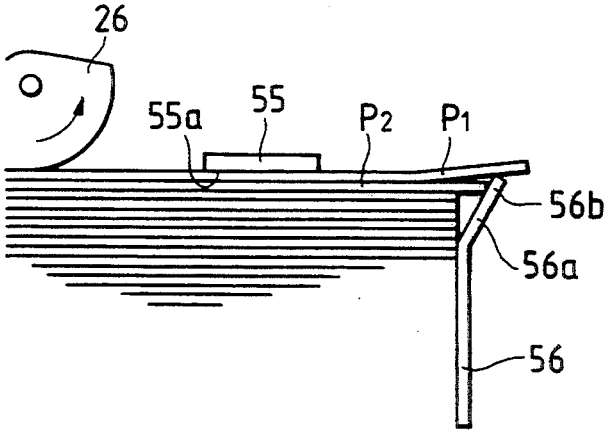

First of all, when the supply rollers 26 are driven, the uppermost sheet $P_1$ in the sheet stack P is shifted in the sheet feeding direction by the friction force between the supply rollers and the uppermost sheet. However, since the clearance $\alpha$ directed to the direction (i.e., the sheet thickness direction) perpendicular to the sheet feeding direction is smaller than the thickness of the single sheet, the forward movement of the uppermost sheet is blocked by the front end limiting members 56. Consequently, the shifted or fed uppermost sheet $P_1$ slides up on the inclined portions 56*a* of the front end limiting members 56, and then rides over the uppermost ends 56*b* of such members to reach intermediate feeding rollers (not shown). FIGS. 4A to 4C show such processes, where, as the supply rollers 26 are rotated continuously, the processes change from a condition of FIG. 4A through a condition of FIG. 4B to a condition of FIG. 4C.

FIG. 4A shows the condition that the sheet stack P is set. From this condition, when the supply rollers 26 are rotated, the uppermost sheet $P_1$ is fed. In this case, as shown in FIG. 4B, a next or second sheet $P_2$ is after shifted together with the uppermost sheet $P_1$ in the sheet feeding direction due to the friction force between the uppermost and next sheets. However, in comparison with the friction force between the supply rollers and the uppermost sheet, which permits the upward sliding movement of the latter along the inclined portions 56*a* of the front end limiting members 56, the friction force between the sheets is small enough to prevent the riding of the second sheet $P_2$ over the inclined portions 56*a* of the front end limiting members 56, as shown in FIG. 4C.

In this case, although the uppermost sheet is shifted while being bent, the hardness (of the sheet) to be bent differs from sheet to sheet. However, since there exist the height limiting members 55, the bent of the uppermost sheet does not occur at a sheet portion rearwardly of the height limiting members 55 (with respect to the sheet feeding direction), but occurs at a portion forwardly of the height limiting members 55 serve to limit not only the up-and-down movement of the sheet stack, but also the bent position of the uppermost sheet. However, when the bending of the uppermost sheet occurs at the position forwardly of the height limiting members 55, the danger of the double-feeding of the sheets will occur.

To avoid this, the height limiting members 55 are arranged forwardly of a position where a bent loop is formed in the uppermost sheet without the height limiting members so that the formation of the bent loop is started frown the front ends of the height limiting members 55, whereby the larger force is required for riding the uppermost sheet over the inclinded portions 56*a* of the front end limiting members 56, thus preventing the double-feeding of the sheets. However, if the height limiting members 55 are arranged excessively forwardly, the resistance of the bent loop in the uppermost sheet will be too strong to ride the sheet over the inclined portions 56*a* even with the aid of the feeding force given by the friction force between the supply rollers 26 and the uppermost sheet $P_1$, thus resulting in the poor feeding.

In the illustrated embodiment, since the clearance $\beta$ directed along the sheet feeding direction between the uppermost ends 56*b* of the front end limiting members 56 and the front ends of the sheet engaging surfaces 55*a* of the height limiting members 55 is selected to have a value of 2–10 mm, the sheet can be effectively fed without the double-feeding of the sheets and the poor feeding.

More particularly, the relation between the feeding force required for slidingly riding the uppermost sheet over the inclined portions 56*a* of the front end limiting members 56 and the feed force given by the supply rollers 26 and the friction force between the sheets is so selected that the feed force is larger than the feeding force and the feeding force is larger than the friction force between the sheets. As a result, even if the particular thicker sheets such as postcards, library cards or envelopes which are not or difficult to be separated one by one by means of a separating claw system for forming a bent loop in the uppermost sheet are used, such thicker sheets can be positively separated one by one and fed with a simple construction without the double-feeding of the sheets.

As the amount of the sheet stack P is reduced, the sheet support plates 45 are gradually moved upwardly by means of the bias means (not shown), with the result that the height level of the front end of the uppermost sheet $P_1$ in the sheet stack P rested on the support plates 45 is always maintained at a predetermined constant level by abutting the upper surface of the sheet stack against the sheet engaging surfaces 55*a* of the height limiting members 55, thus permitting the stable separation and feeding of the single sheet at all times.

Next, a second embodiment of the present invention will be explained with reference to FIG. 5.

In the above-mentioned first embodiment, the front end of the uppermost sheet $P_1$ fed by the supply rollers 26 rides over the inclined portions 56*a* of the front end limiting members 56. The front end of the uppermost sheet $P_1$ is subjected to a reaction force from the inclined portions 56*a* when it rides over the latter; accordingly, a position where the sheet is bent is determined by a relation between the reaction force and the hardness to be bent (of the sheet). If the position where the sheet is bent is far from the front end of the sheet which rides over the inclined portions 56*a*, even fairly thicker sheet can be bent enough to ride over the inclined portions 56*a* by the same feeding force because the moment of the reaction force (from the inclined portions) acting on the sheet is constant.

This refers to the relation between the position where the upper surface of the sheet stack is limited, and the distance from the position where the front end of the sheet is limited to the position where the upper surface of the sheet stack is limited, and the hardness (to be bent) of the sheet to be used. In this respect, there is no problem if the position where the upper surface of the sheet stack is limited is situated rearwardly of the position where the uppermost sheet is bent, but, if the position where the upper surface of the sheet stack is limited is situated forwardly of the position where the uppermost sheet is bent, the sheet will be bent at the front ends of the height limiting members, thus causing the poor feeding of the thicker sheet.

In view of the above, according to the second embodiment (FIG. 5), the position of each height limiting member 55 can be adjusted along the sheet feeding direction so that the position where the uppermost sheet is bent can be adjusted by adjusting the clearance $\beta$ directed along the sheet feeding direction between the height limiting members 55 and the front end limiting members 56.

Figure 5:
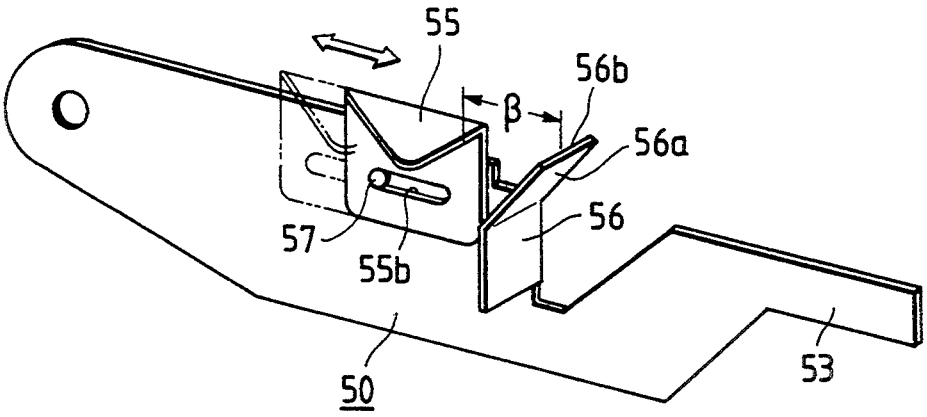
FIG. 5 is a perspective view of a sheet separating lever according to a second embodiment.

FIG. 5 is a perspective view of a sheet separating lever 50 wherein the position of the height limiting member 55 can be adjusted. In this arrangement, the height limiting member 55 is formed separately from the body of the lever 50 and is provided with a longitudinal slot 55*b* extending in the sheet feeding direction. The height limiting member 55 is assembled onto the lever 50 in such a manner that the longitudinal slot 55*b* of the member 55 is slidably engaged by a boss 57 formed on the lever 50. With this arrangement, the height limiting member 55 can be slid with respect to the body of the lever 50 in the sheet feeding direction through a range determined by the length of the longitudinal slot 55*b* while keeping the height limit member 55 at a constant level. If the height limiting member 55 is shifted forwardly toward the front end limiting member 56 of the lever 50, the clearance $\beta$ between the members 55 and 56 will be decreased; whereas, if the height limiting member 55 is shifted rearwardly away from the front end limiting member 56, the clearance $\beta$ will be increased. The height limiting member 55 can be locked in place by means of an appropriate locking means (not shown).

As mentioned above, the longer the distance between the front end of the height limiting member 55 and the uppermost end 56*b* of the inclined portion 56*a*, the easier the riding of the uppermost sheet over the inclined portion 56*a*; whereas, the shorter such distance the harder the riding-over of the uppermost sheet. Accordingly, when the considerably thicker sheets are used, the height limiting member 55 is set in a position shown by the two-dot chain line (FIG. 5) where the height limiting member 55 is far from the front end limiting member 56, whereas, when the thinner sheets are used, the height limiting member 55 is set in a position shown by the solid line in FIG. 5 where the height limiting member 55 is near the front end limiting member 56. In this way, the double-feeding of the sheets and/or the poor feeding can be prevented more effectively, with respect to not only the considerably thicker sheet but also the thinner sheet.

Figure 6A:
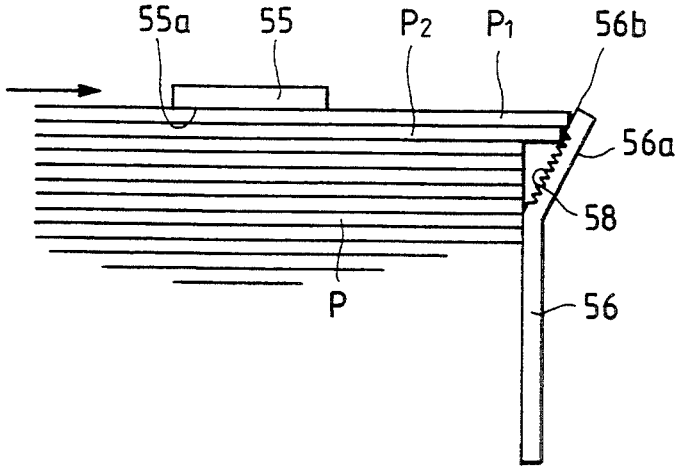
FIGS. 6A, 6B and 6C are explanatory views showing processes that only a single sheet is separated from the other sheets, by a sheet separating apparatus according to a third embodiment of the present invention.
Figure 6B:
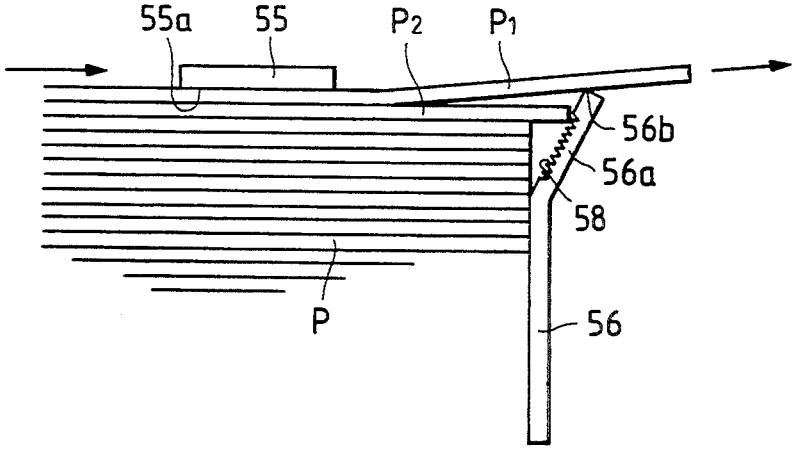
Figure 6C:
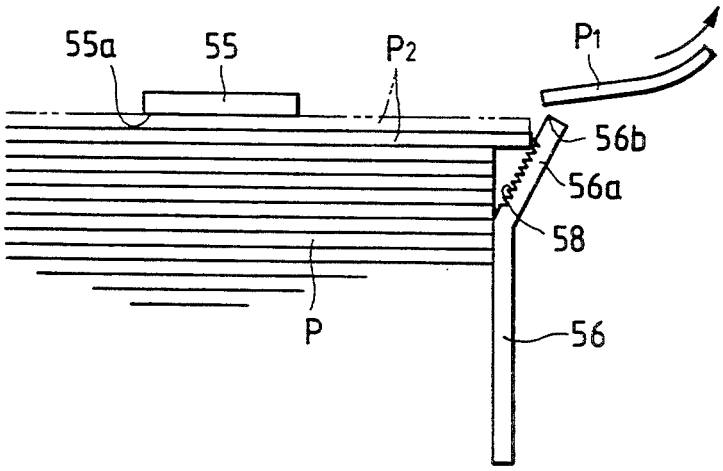

Next, a third embodiment of the present invention will be explained with reference to FIG. 6.

According to this third embodiment, in order to avoid the double-feeding of the sheets, the inclined portions 56*a* of the front end limiting members 56 are improved. More particularly, the coefficient of friction on a surface area of the inclined portion 56*a* against which the uppermost sheet $P_1$ is abutted is varied from the coefficient of friction on the remaining surface ,area of the inclined portion 56*a* against which the next and other sheets are abutted. The surface area (of the inclined portion 56*a*) against which the uppermost sheet has the low coefficient of friction $\mu_1$ to permit the easier sliding movement of the sheet, whereas the remaining surface area (of the inclined portion) against which the next and other sheets are abutted has the high coefficient of friction $\mu_2$ to obtain the harder sliding movements of the sheets ($\mu_1 < \mu_2$).

According to the illustrated embodiment, the above-mentioned remaining surface area of the inclined portion 56*a* against which the next and other sheets are abutted is provided with a plurality of recesses 58 thereon. On the other hand, the surface area against which the uppermost sheet is abutted has no such recesses. Accordingly, the uppermost sheet $P_1$ contacting with the surface area having no recess can easily be slid upwardly on the inclined surfaces 56*a*, but, the next and other sheets contacting with the surface area having the recesses 58 cannot be slide upwardly on the inclined portions due to the resistance of the recesses 58, with the result that these sheets are not fed together with the uppermost sheet $P_1$ (see FIGS. 6A and 6B). After the uppermost sheet $P_1$ has been fed out, since the sheet support plates 45 are lifted upwardly by the bias means, the next or second sheet $P_2$ is positioned at the level in confronting relation to the surface area having no recess (see FIG. 6C), and the same process is repeated. In this case, since the inclined portions 56*a* are inclined toward the sheet feeding direction, the lifting of the sheet stack P performed by means of the bias means through the support plates is not obstructed.

Next, a fourth embodiment of the present invention will be explained with reference to FIG. 7.

While in the above-mentioned third embodiment the recesses 58 were formed on the surface area of each of the inclined portion 56*a* to vary the coefficients of friction on the inclined portion, means for providing the high coefficient of friction on the surface area against which the next and other sheets are abutted are not limited to one shown in the above third embodiment. According to the fourth embodiment, the surface area of the inclined portion 56*a* against which the next and other sheets are abutted comprises a high friction member 59 such as rubber. The coefficient of friction of the friction member 59 is selected to have a value larger than that of the coefficient of friction of the material which constitutes the inclined portion 56*a*. Accordingly, the fourth embodiments provides not only the same advantage as that of the third embodiment, but also more reliable operation by permitting the replacement of the friction member 59 in accordance with the material of the sheet to be used.

Next, a fifth embodiment of the invention will be explained with reference to FIGS. 8 to 12.

Figure 8:
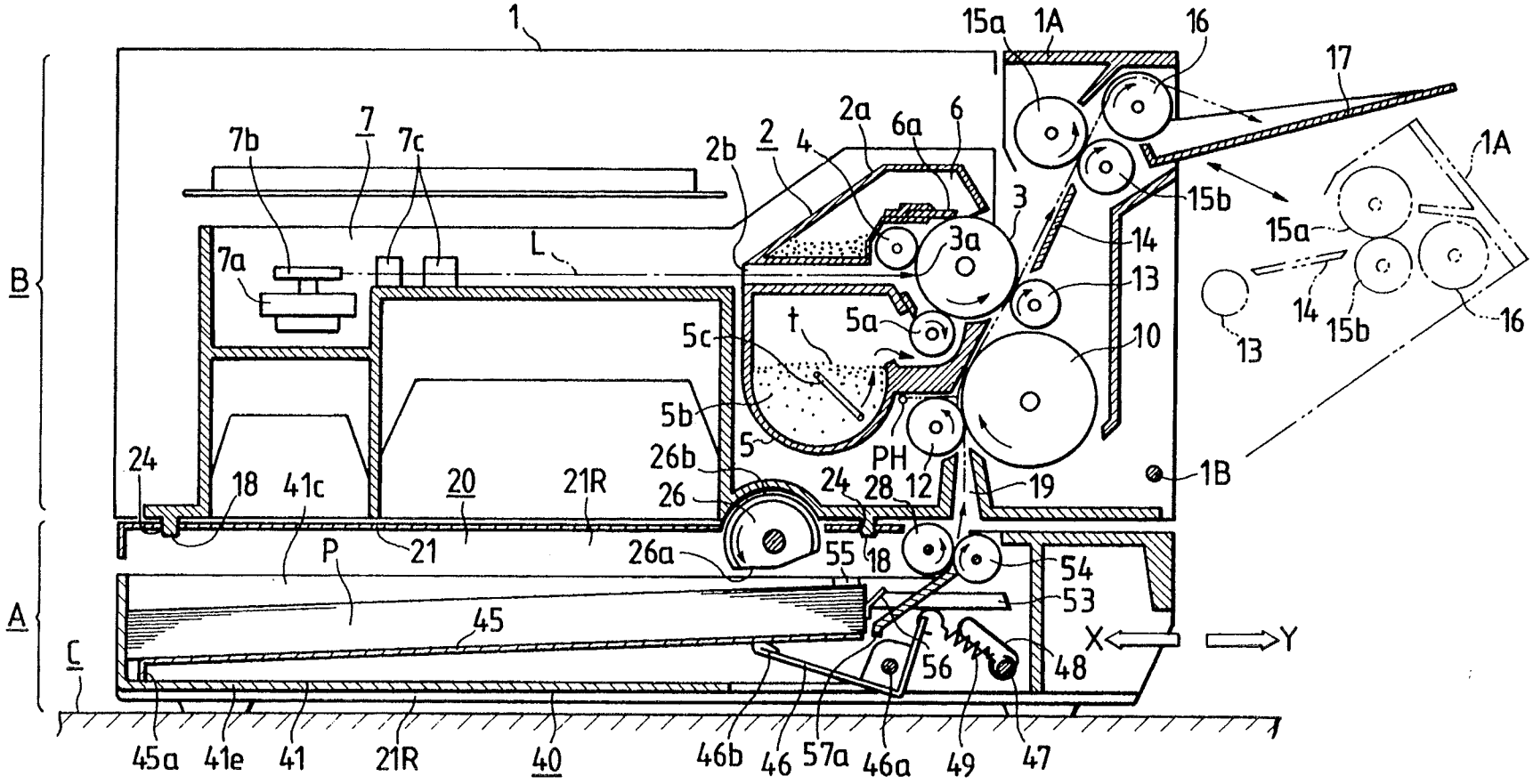
FIG. 8 is an elevational sectional view of a laser beam printer incorporating the sheet separating apparatus according to fifth embodiment.

In this fifth embodiment, an example of a laser beam printer B incorporating a sheet feeding apparatus A according to the present invention. FIG. 8 is an elevational view of the apparatuses A and B.

The sheet feeding apparatus A according to the fifth embodiment is formed independently from the printer B as a main apparatus and is constituted as an optional unit detachably mounted on the printer B to be used in combination. The sheet feeding apparatus A is installed on a floor or support C, and then the printer (main apparatus) B is assembled onto the sheet feeding apparatus A in such a manner that downward projections 18 formed on the bottom of the printer are fitted into corresponding holes 24 formed in an upper plate 21 of the sheet feeding apparatus A.

The reference numeral 19 denotes a sheet receiving inlet formed in the bottom of the printer in confronting relation to the nip between a sheet feeding roller 10 and a sheet conveying roller 12. The sheet receiving inlet 19 is positioned above a pair of sheet feeding rollers 28, 54 situated at a front part of the upper plate 21 of the sheet feeding apparatus A when the printer B is positioned and assembled on the sheet feeding apparatus as mentioned above. Hereinafter, the printer and the sheet feeding apparatus will be fully explained.

I. Printer B

The reference numeral 1 denotes a frame or housing of the printer having a front side corresponding to the right end of FIG. 8. The reference numeral 1A denotes a front end plate of the printer, which front end plate 1A can be rocked with respect to the housing 1 around a lower pivot 1B between an open position shown by the two-dot chain line and a closed position shown by the solid line. Mounting or dismounting of a process cartridge 2 with respect to the printer, or inspection and/or maintenance of the printer are performed in a condition that the front end plate 1A is fully opened to expose the interior of the printer.

The process cartridge 2 is here shown to include a cartridge housing 2*a* accommodating four processing devices for forming an image, i.e., a photosensitive drum 3, a charger roller 4, a developing device 5 and a cleaner 6. When the front end plate 1A is opened to its open position shown by the two-dot chain line, the process cartridge 2 can be inserted into or removed from a predetermined position within the printer housing 1. When the cartridge 2 is correctly mounted within the printer, mechanical driving mechanisms and electrical circuit systems in the cartridge are mechanically and electrically interconnected to mechanical driving mechanisms and electrical circuit systems in the printer through interface couplings (not shown).

The reference numeral 7 denotes a laser beam scanner portion arranged at a rear side within the printer housing 1, which scanner portion 7 comprises a semi-conductor laser, scanner motor 7*a*, polygonal mirror 7*b* and lens system 7*c*. A laser beam L emitted from the scanner portion 7 enters, in a substantially horizontal direction, into the process cartridge mounted within the printer through an exposure window 2*b* formed in the cartridge housing 2*a* and passes through a passage between the upper cleaner 6 and the lower developing device 5 to reach an exposure portion 3*a* on the left side of the photosensitive drum 3, whereby the photosensitive drum 3 is scanned and exposed by the laser beam in its generatrix direction.

The sheet conveying roller 12 is arranged within the printer housing 1. The reference numeral 13 denotes a transfer roller arranged above the sheet feeding roller 10 within the printer front end plate 1A; 15*a* and 15*b* denotes a pair of fixing rollers arranged at an upper side within the printer front end plate 1A; 14 denotes a sheet guide plate arranged between the transfer roller 13 and the paired fixing rollers 15*a*, 15*b*; 16 denotes an ejector roller arranged at a downstream side of the paired fixing rollers 15*a*, 15*b*; and 17 denotes a sheet receiving ejector tray.

When an image forming start signal is inputted to a control system of the printer, the photosensitive drum 3 is rotated at a predetermined peripheral speed in an anti-clockwise direction shown by the arrow, and the peripheral surface of the drum 3 is uniformly charged with a predetermined plus or minus polarity by means of the charger roller 4. The charger roller 4 comprises a conductive member having applied to it a predetermined voltage, and the photosensitive drum 3 is charged by the charger roller 4 with a so-called contacting (direct) charging method. The charger roller 4 may be driven by the rotation of the photosensitive drum 3, or may be drivingly rotated in a reverse direction, or may be a non-rotating type. Further, the charging may be frictional charging or corona charging.

Then, at the exposure portion 3*a*, the uniformly charged surface of the photosensitive drum 3 receives the pixel (picture element) laser beam L corresponding to the electrical timing pixel signals of image information outputted from the scanner portion 7, whereby a photostatic latent image corresponding to the image information is gradually formed on the surface of the photosensitive drum 3 by gradually scanning the drum surface with the laser beam L in the generatrix direction.

The latent image formed on the surface of the drum 3 is gradually developed to form a toner image by the developer beared on a developing sleeve or roller 5*a* in the developing device 5. The reference numeral 5*b* denotes a containing chamber for accommodating the developer (toner); and 5*c* denotes an agitating member for agitating the developer in the containing chamber. When the agitating member 5*c* is rotated in a direction shown by the arrow, it agitates the developer t in the containing chamber 5*b* and gradually supplies the developer to the developing sleeve 5*a*.

On the other hand, in the sheet feeding apparatus A, the uppermost sheet in the sheet stack P is separated from the sheet stack and is fed into the printer B through the sheet receiving inlet 19 formed in the bottom of the printer B. The fed sheet is pinched between the feeding roller 10 and the conveying roller 12 and is introduced into the interior of the printer B so that the sheet is fed toward the nip (transfer area) between the photosensitive drum 3 and the transfer roller 13 at a constant speed equal to the peripheral speed of the photosensitive drum 3. During the feeding of the sheet, a leading edge of the sheet is detected by a sheet sensor PH arranged in a sheet path between the feeding roller 10 and the transfer roller 13. On the basis of a sheet leading edge detection signal emitted from the sheet sensor PH, a timing when the scanning exposure of the image information (writing of the image information) on the surface of the photosensitive drum 3 by means of the scanner portion 7 is started is determined.

While the sheet is gradually passed through the transfer area between the photosensitive drum 3 and the transfer roller 13, the toner image on the photosensitive drum 3 is gradually transferred onto the sheet by the voltage applied to the transfer roller 13 and having the polarity opposite to that of the toner and the contacting pressure between the transfer roller 13 and the photosensitive drum 3. The voltage starts to be applied to the transfer roller 13 when the leading edge of the sheet reaches the transfer area (or nip) between the photosensitive drum 3 and the transfer roller 13. The transfer roller 13 may be a corona charger.

The sheet passed through the transfer area is separated from the surface of the photosensitive drum 3 and is guided by the guide plate 14 to reach the paired fixing rollers 15*a*, 15*b*. One (15*a*) of the paired rollers 15*a*, 15*b* which contacts the transferred surface of the sheet comprises a heating roller incorporating a halogen heater therein, whereas the other roller 15*b* comprises an elastic pressure roller. While the sheet having the transferred image thereon is passed through between the paired rollers 15*a*, 15*b*, the transferred toner image is fixed onto the sheet by the heat and pressure. Then, the sheet is ejected as a printed matter onto the ejector tray 17 through the ejector roller 16.

The surface of the photosensitive drum 3 after the toner image has been transferred therefrom to the sheet is cleaned by a cleaning blade 6a of the cleaner 6 to remove the residual toner and other foreign matters. Thus, the cleaned drum surface can be used for next image forming process.

II. Sheet Feeding Apparatus A

The sheet feeding apparatus A comprises a sheet feeder 20 including at least a sheet feeding means and a driving means therefor, and a sheet cassette 40 as a sheet container which can be removably inserted into the sheet feeder.

Figure 9:
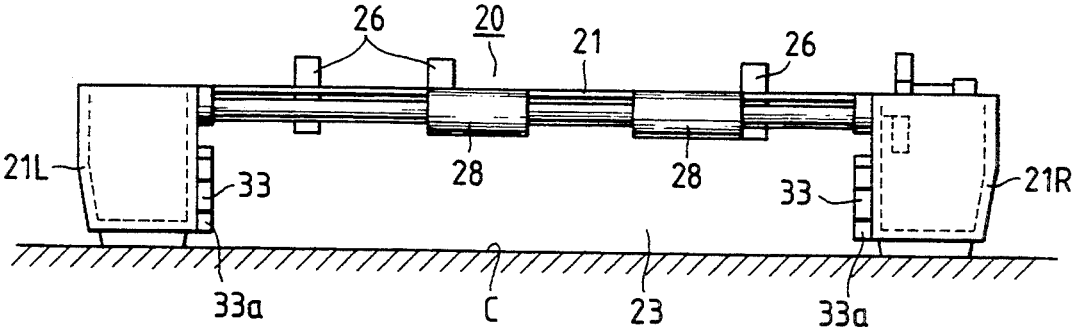
FIGS. 9 and 10 are a front view and a side sectional view of a feeder of the sheet feeding apparatus, respectively.
Figure 10:
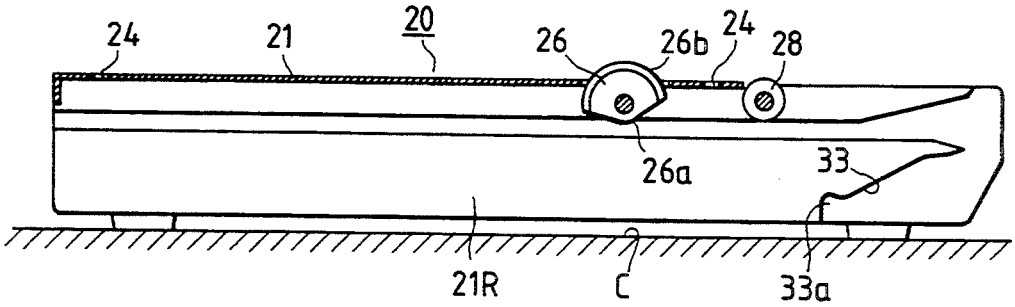
Figure 11:
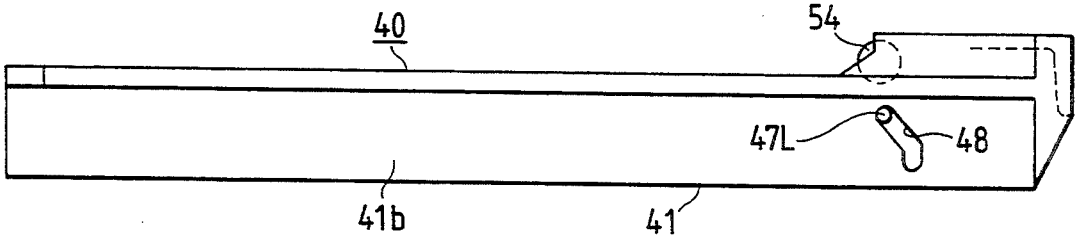
FIGS. 11 and 12 are a left side elevational view and a side sectional view of a sheet cassette, respectively.
Figure 12:
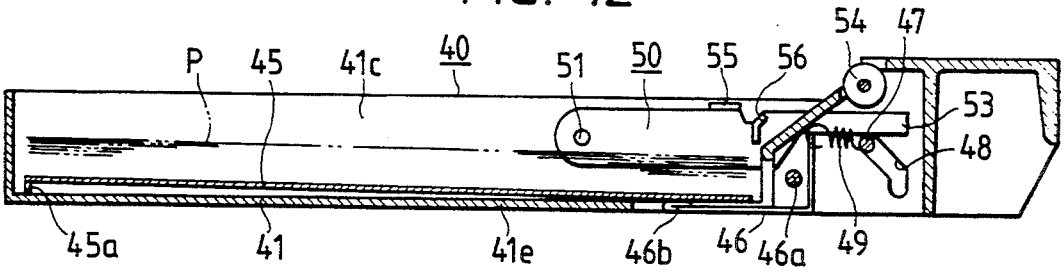

FIGS. 9 and 10 are a front view and an elevational sectional view of the sheet feeder 20, respectively, and FIGS. 11 and 12 are a left side view and a side sectional view of the sheet cassette 40, respectively.

The feeder 20 includes a pair of left and right parallel base frames 21L and 21R, an upper plate 21 interconnecting the base frames, supply rollers 26 of arcuate configuration, supply roller driving means (not shown) arranged within the base frames, and one roller 28 of the paired feeding rollers 28, 54. The sheet cassette 40 is mounted in a space defined by an under surface of the upper plate 21, an upper surface of the support C and inner surfaces of the left and right base frames 21L, 21R by inserting the cassette from the front side of the feeder (FIG. 8). The sheet cassette can be removed by retracting it from the space.

The sheet cassette 40 includes a cassette casing 41, an intermediate plate 45 acting as the sheet support plate arranged within the cassette casing and pivotable around a rear end 45*a* thereof, a pressure lever 46 acting to bias a front end of the intermediate plate 45 upwardly and pivotable around a pivot pin 46*a*, a pressure shaft 47 for rocking the pressure lever 46 through a spring 49, a pair of left and right sheet separating levers 50 which are pivotably mounted on inner faces of side walls 41*b*, 41*b* of the cassette casing 41 for pivotal movement around pivots 51, and the other roller 54 of the paired feeding rollers 28, 54.

The sheets P are rested on the intermediate plate 45 in the cassette casing 41 and housed in the cassette. The pair of left and right sheet separating levers 50 have the same construction as those shown in the first to third embodiment, and each has a front end limiting member 56 as a first limiting means, and a height limiting member 55 as a second limiting means.

When the cassette 40 is removed from the feeder 20, or before the cassette 40 is correctly mounted with respect to the feeder 20, the intermediate plate 45 is not subjected to a rotational lifting force from the pressure lever 46 and is held in a condition that it is laid on a bottom plate 41*e* of the cassette casing 41 as shown in FIG. 12, and the sheet stack P on the intermediate plate 45 is maintained within the cassette casing 41 in a horizontal posture. Thus, while the cassette 40 is being inserted in the feeder 20, an upper surface of the sheet stack P housed in the cassette casing 41 is adequately spaced apart from the chord portions 26*a* (of the supply rollers 26) directed downwardly, whereby the interference between the upper surface of the sheet stack P in the cassette 40 and the supply rollers 26 at the feeder side is prevented.

That is to say, by designing each supply roller 26 at the feeder side as the arcuate configuration having the chord portion 26*a* and by normally maintaining the chord portions 26*a* of the supply rollers 26 to direct downwardly, a height of the space 23 defined by the under surface of the upper plate 21 of the feeder, the upper surface of the support C and the inner surfaces of the left and right base frames 21L, 21R can be increased, with the result that the sheet accommodating ability of the cassette 40 can be increased accordingly. Immediately before the cassette 40 in inserted into the correct position, both ends 47L, 47R of the pressure shaft 47 projecting outwardly from the side walls 41*b*, 41*c* of the cassette engage camming recesses 33 formed in the inner surfaces of the left and right base frames 21L, 21R of the feeder 20, whereby, during the further insertion of the cassette 40, the left and right ends 47L, 47R of the pressure shaft 47 are urged downwardly by the camming recesses 33, thus lowering the pressure shaft 47 from its upper terminal position to its lower terminal position along an inclined slot 48 in which the pressure shaft is received. Following to the lowering movement of the pressure shaft 47, the pressure lever 46 is rotated in a clockwise direction around the pivot 46*a* through the tension coil spring 49, thus cocking a horizontal arm 46*b* of the pressure lever 46, whereby the intermediate plate 45 on which the sheet stack P is rested is rocked upwardly around the rear end 45*a* thereof to assume an inclined posture inclined forwardly and upwardly.

When the cassette 40 is fully inserted and correctly mounted within the printer, the pressure shaft 47 reaches the lower limit of the inclined slot 48, and the both ends 47L, 47R of the shaft are held in the lowermost ends 33*a* of the camming recesses 33 not to be returned upwardly.

On the other hand, as the pressure shaft 47 is lowered along the inclined slot 48, during the initial lowering of the pressure shaft, since extensions 53 of the sheet separating levers 50 resting on the pressure shaft 47 are also lowered, the sheet separating levers 50 are rotated in the clockwise direction. However, when the height limiting members 55 of the levers 50 are engaged by the upper surface of the sheet stack P lifted by the upward rocking movement of the front end of the intermediate plate 45 caused by the lowering movement of the pressure shaft 47, the rotation of the sheet separating levers 50 is stopped. But, since the pressure shaft 47 is further lowered, the extensions 53 of the sheet separating levers 50 are disengaged from the pressure shaft 47. Consequently, the sheet separating levers 50 are rested on the sheet stack P with their own weights, thus assuming the setting conditions.

In this way, whenever the supply rollers 26 at the feeder side are rotated by one revolution, the uppermost sheet in the sheet stack P housed in the cassette 40 mounted on the feeder 20 is separated and fed one by one, in the same manner as those described in the aforementioned first to fourth embodiments, and is sent to the interior of the printer B through the paired feeding rollers 28, 54 and the sheet receiving inlet 19; thereafter, the image forming operations as mentioned above are successively performed with respect to the fed sheet.

As the amount of the sheets P stacked in the cassette 40 is reduced, the intermediate plate 45 is gradually lifted by the gradual clockwise rotation of the pressure lever 46 by the charge force of the tension coil spring 49. As a result, the height lever of the front end of the uppermost sheet in the sheet stack P rested on the intermediate plate 45 is always maintained at a predetermined constant level, thus permitting the stable single sheet separation and feeding at all times.

Next, a sixth embodiment of the present invention will be explained with reference to FIG. 13.

In this sixth embodiment, the sheet is separated by double separating means, one of which is constituted by the sheet separating gate means shown in the aforementioned first to fourth embodiments and the other of which is constituted by a double-feed preventing pad made of high friction material such as rubber, thus improving the double-feed preventing ability.

In FIG. 13, showing a condition wherein the double-feeding of the sheets is prevented by the double-feed preventing pad, the reference numeral 26 denotes a supply roller having an arcuate configuration; 55 denotes a height limiting member; and 56 denotes a front end limiting member, and these elements may be the same as those shown in the aforementioned first to fourth embodiments.

In FIG. 13, the reference numerals 28, 54 denote a pair of sheet feeding rollers as an intermediate sheet conveying means, which are positioned at a downstream side of the members 55, 56 as the sheet separating gate means with respect to the sheet feeding direction. The reference numeral.57 denotes a sheet double-feed preventing pad arranged between the intermediate sheet conveying means 28, 54 and the sheet separating gate means 55, 56. In the illustrated embodiment, the pad 57 is inclined with respect to a sheet feeding direction of the sheet outcoming from the gate between the members 55 and 56 at an angle of $\theta_1$, which is included in a range $0° \leqq \theta_1 \leqq 45°$, so that the leading end of the sheet passed through the pad is directed toward the nip between the feeding rollers 28, 54. Further, the pad 57 is arranged at a downstream side of the supply rollers 26 in the sheet feeding path and is positioned at an intermediate position between the supply rollers 26 in the transverse direction.

Figure 13A:
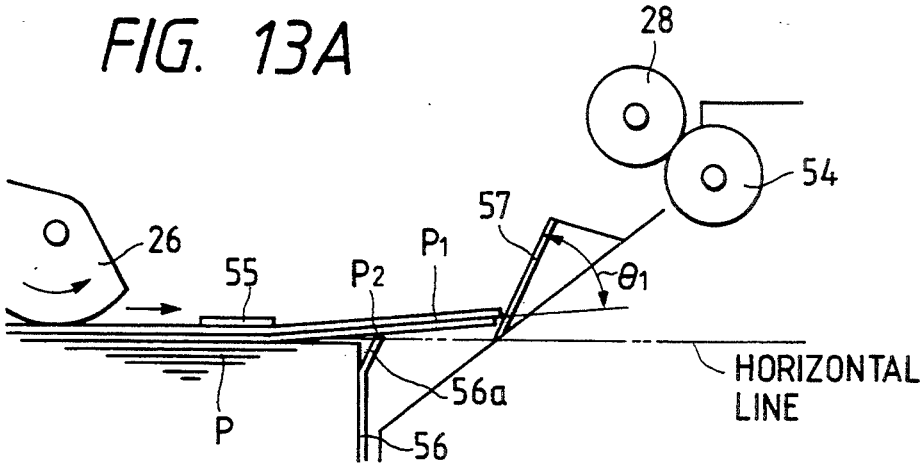
FIGS. 13A, 13B and 13C are explanatory views showing processes that only a single sheet is separated from the other sheets by a sheet feeding apparatus according to a sixth embodiment of the present invention.
Figure 13B:
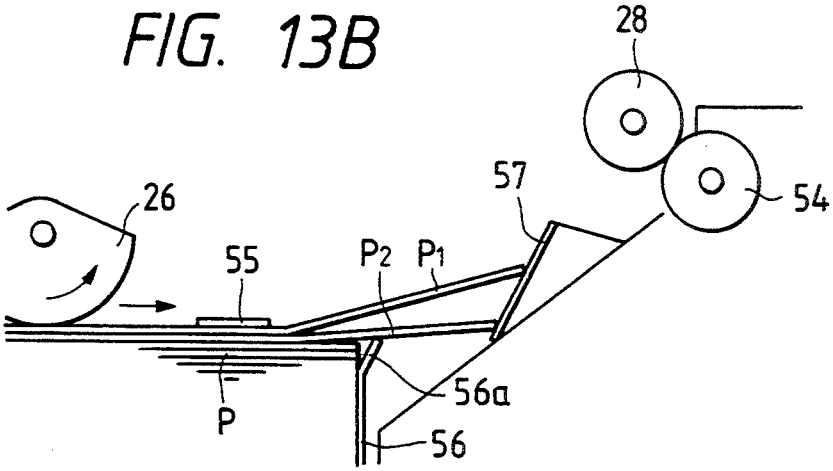
Figure 13C:
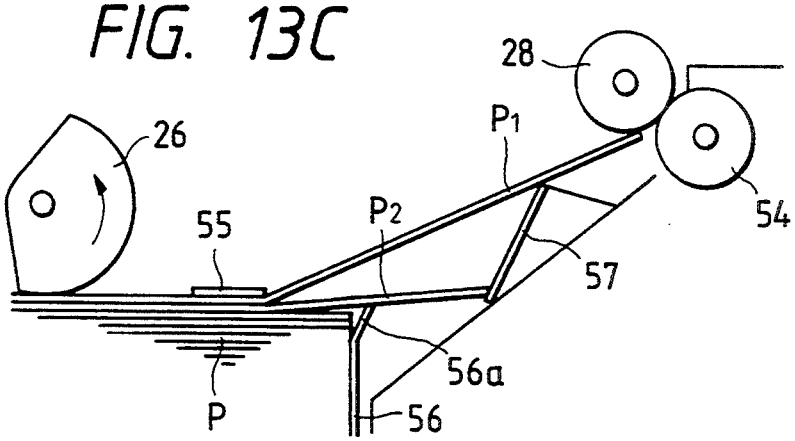

As shown in FIG. 13A, the front ends of the uppermost sheet $P_1$ and of the next sheet $P_2$ moved together with the uppermost sheet are line-contacted with the double-feed preventing pad 57. As the supply rollers 26 are further rotated, as shown in FIGS. 13B and 13C, the uppermost sheet $P_1$ subjected to the adequate feeding force from the supply rollers by contacting them can pass through the double-feed preventing pad 57 while abutting the front end thereof against the pad; but, the next sheet $P_2$ moved together with the uppermost sheet by the friction force between the sheets cannot be pass through the double-feed preventing pad 57.

As mentioned above, if the second or next sheet $P_2$ is not separated from the uppermost sheet by the gate means between the members 55, 56 and is moved together with the uppermost sheet, the next sheet $P_2$ cannot pass through the double-feed preventing pad 57, and accordingly, only the uppermost sheet $P_1$ is fed to the nip between the feeding rollers 28, 54 to be further fed toward the image forming portion and the like.

The next sheet $P_2$ blocked by the double-feed preventing pad 57 will be a new uppermost sheet in the next sheet feeding operation, and, thus, is subjected to the adequate feeding force from the supply rollers 26 enough to pass through the double-feed preventing pad 57, with the result that this sheet can be fed to the nip between the feeding rollers 28, 54.

Figure 14:
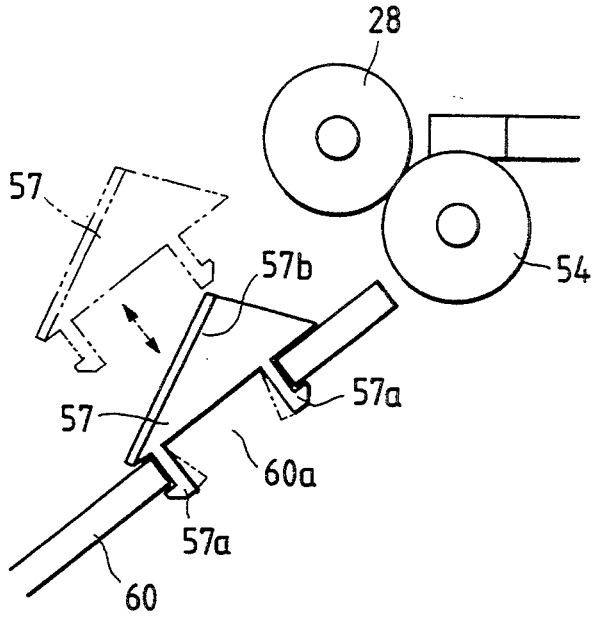
FIG. 14 is a side view of a main portion of a sheet feeding apparatus according to a seventh embodiment of the present invention.

Next, a seventh embodiment of the present invention will be explained with reference to FIG. 14.

In this embodiment, a double-feed preventing pad 57 is removably or replaceably arranged in the sheet feeding path between the members 55, 56 and the feeding rollers 28, 54. The double-feed preventing pad 57 is provided at its bottom with engaging legs 57*a*, which can be engaged by an engaging recess or opening 60*a* formed in a stationary member 60 arranged in the sheet feeding path. By engaging the legs 57*a* by the opening 60*a*, the pad 57 is held stationary in the sheet feeding path; on the other hand, by flexing the legs 57*a* to release them from the opening 60*a*, the pad 57 can be easily removed.

Accordingly, by preparing several double-feed preventing pads 57 including friction portions 57*b* each having the different area, material and/or inclination (with respect to the sheet feeding direction), the double-feed preventing pad having the proper features regarding the sheet to be used can easily be adopted to in accordance with the sheet to be used. Further, the service life of the double-feed preventing pad 57 is relatively shorter (in comparison with other parts), because the friction portion 57*b* thereof is scraped by the sheets successively fed. By permitting the replacement of the double-feed preventing pad having the shorter service life, the pad can be easily changed, with the result that the service life of the whole apparatus can be extended.

Further, although the pad 57 has an important role for preventing the double-feeding of the sheets, since it is arranged in the sheet feeding path, it inherently provides the resistance to the feeding of the sheet after the prevention of the double-feeding. However, this embodiment has an advantage that, when the sheets which are completely separated by the gate means without the double-feed preventing pad are used, the double-feed preventing pad giving the resistance to the feeding of the sheet can be removed or omitted.

Figure 15A:
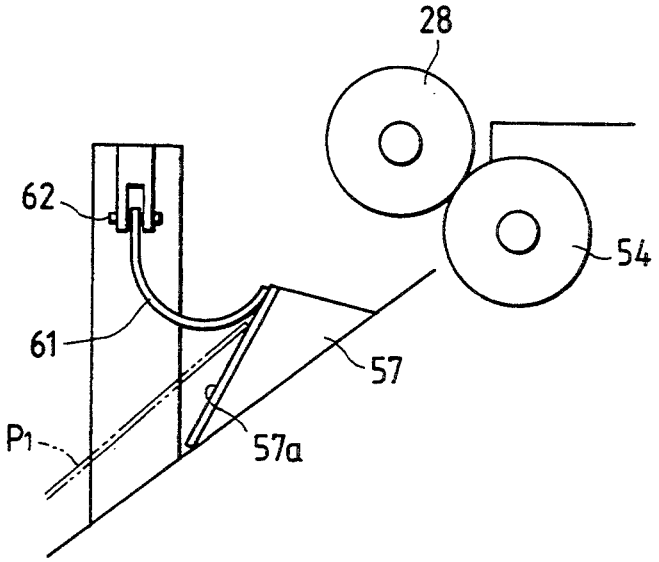
FIGS. 15A and 15B are side view and a perspective view of a main portion of a sheet feeding apparatus according to an eighth embodiment of the present invention.

Next, an eighth embodiment of the present invention will be explained with reference to FIG. 15.

Figure 15B:
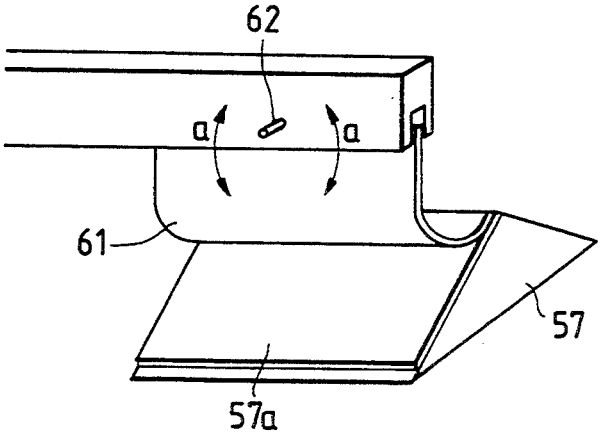

In this eighth embodiment, a pressure member 61 for pressing the sheet outcoming from the gate means against the double-feed preventing pad 57 is provided, and such pressure member 61 is pivotable as shown by the arrow a in FIG. 15B.

The sheet(s) passed through the gate means by the rotational force or feeding force of the supply rollers is abutted against the double-feed preventing pad 57. However, the position where the front end of the sheet is abutted against the double-feed preventing pad 57 varies from the expected position in accordance with the circumferential conditions and/or the deformation of the sheet itself. Particularly, if envelopes are used, since the deformation thereof is noticeably in comparison with other sheets, the front end of the envelope does not after always encounter the double-feed preventing pad 57.

However, in the eighth embodiment, even if the sheet is considerably deformed enough not to encounter the double-feed preventing pad 57, the fed sheet is always abutted against the double-feed preventing pad 57 due to the presence of the pressure member 61. And, the front end of the sheet is always pressed against the double-feed preventing pad 57 by the weight of the pressure member 61 itself or the elastic force thereof. Accordingly, the reliability of the double-feeding prevention is further improved.

Further, in this case, since the sheet is pressed against the double-feed preventing pad 57, if the pressing force of the sheet on the double-feed preventing pad 57 is not uniform, a problem of skew-feed will occur. However, as shown in FIG. 15B, since the pressure member 61 is pivotable around a pivot 62 to keep the uniform pressing force of the sheet, such skew-feed does not occur.

While the pressure member 61 was pivotable, the double-feed preventing pad 57 may be pivotable to keep the uniform pressing force of the sheet. Further, if the pressure means for applying the pressing force to the double-feed preventing pad 57 is constituted by a rotary mechanism such as a roller (in place of the pressure member), there is a further advantage that the feeding resistance; due to the presence of the pressure member 61 can be decreased.

Figure 7:
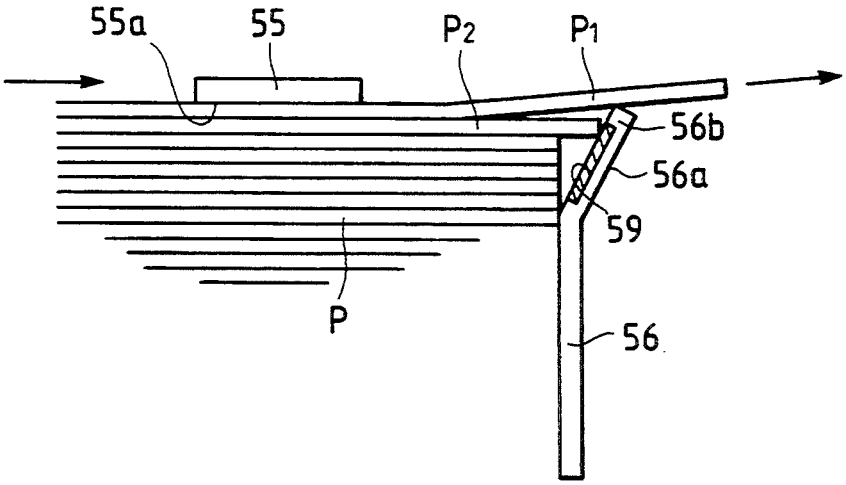
FIG. 7 is an enlarged side view of a main portion of a sheet separating lever according to a fourth embodiment.

In the sixth to eighth embodiments (FIGS. 13 to 15), the sheet separating gate means may be replaced by those shown in the second embodiment (FIG. 5), third embodiment (FIG. 6) and fourth embodiment (FIG. 7).

Further, the sixth to eighth embodiments can be applied to the laser beam printer shown in the fifth embodiment (FIGS. 8 to 12). In this case, the double-feed preventing pad 57 is attached to an inclined guide 57*a* (FIG. 8) formed on the sheet cassette 40.

Next, a ninth embodiment of the present invention will be explained with reference to FIGS. 16 to 20.

Figure 17A:
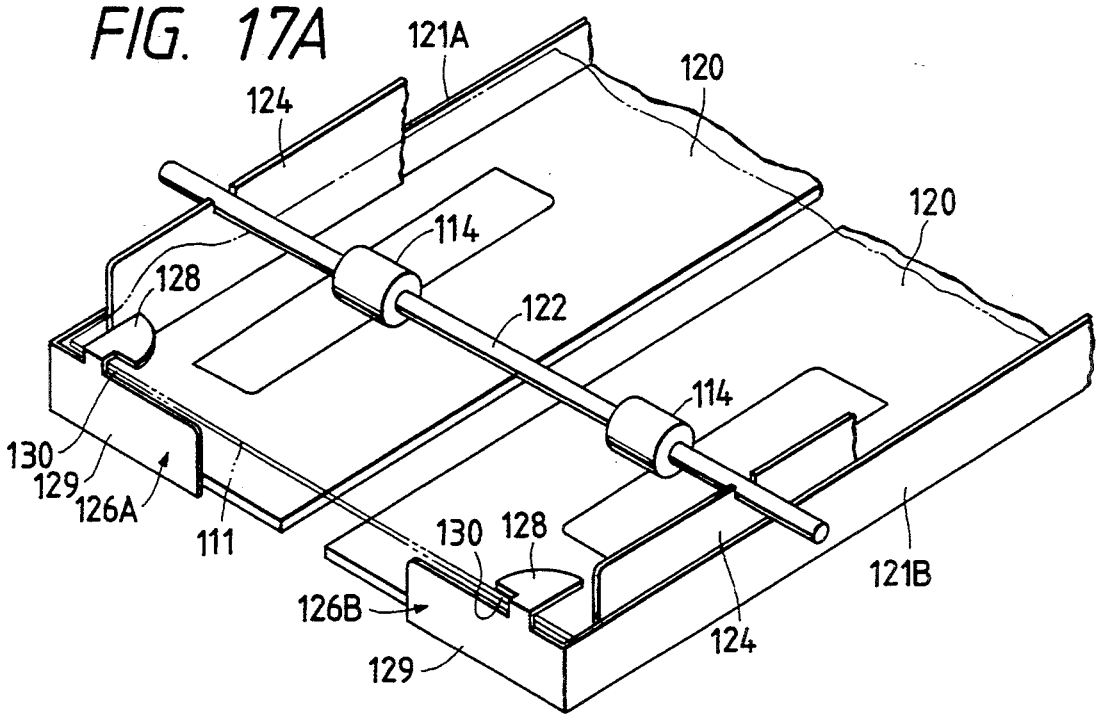
FIGS. 17A and 17B are perspective views of the sheet feeding apparatus the ninth embodiment.
Figure 17B:
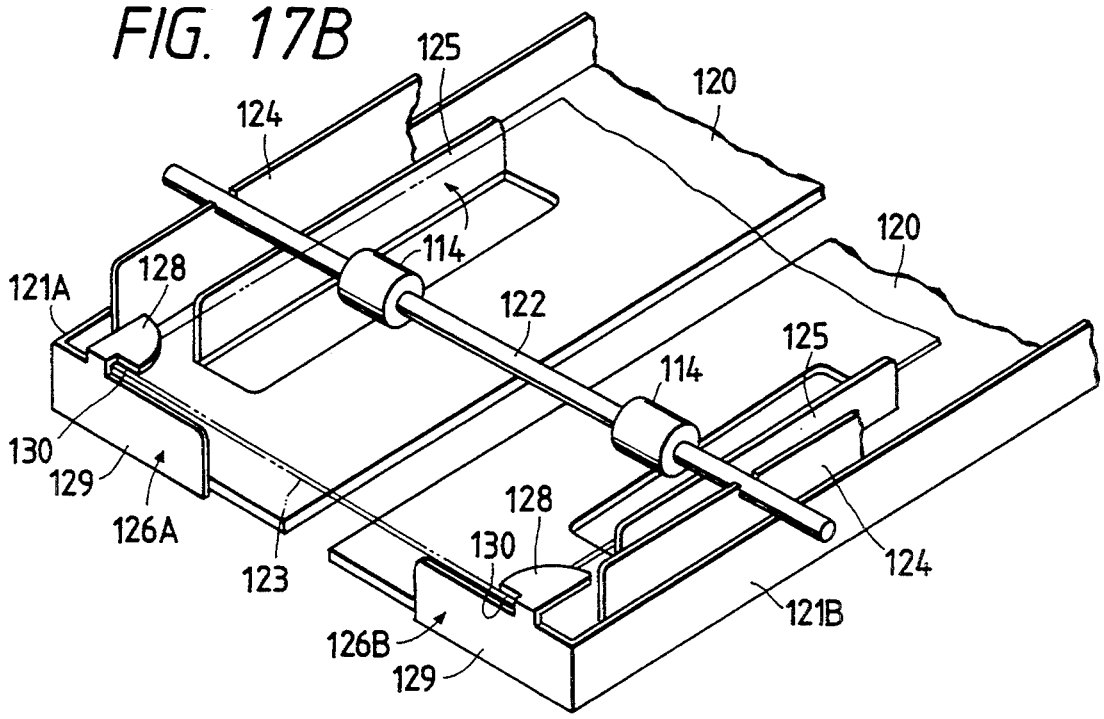

FIG. 17 is a perspective view of a sheet feeding apparatus according to a ninth embodiment of the present invention, and in particular, FIG. 17A shows a condition of the apparatus that normal or plain sheets are used, and FIG. 17B shows a condition of the apparatus that thicker sheets are used. Further, FIG. 18 is a plan view showing a left separating claw of the apparatus of FIG. 17, and FIG. 19 is a front view looked at along the line III—III of FIG. 18.

Figure 18:
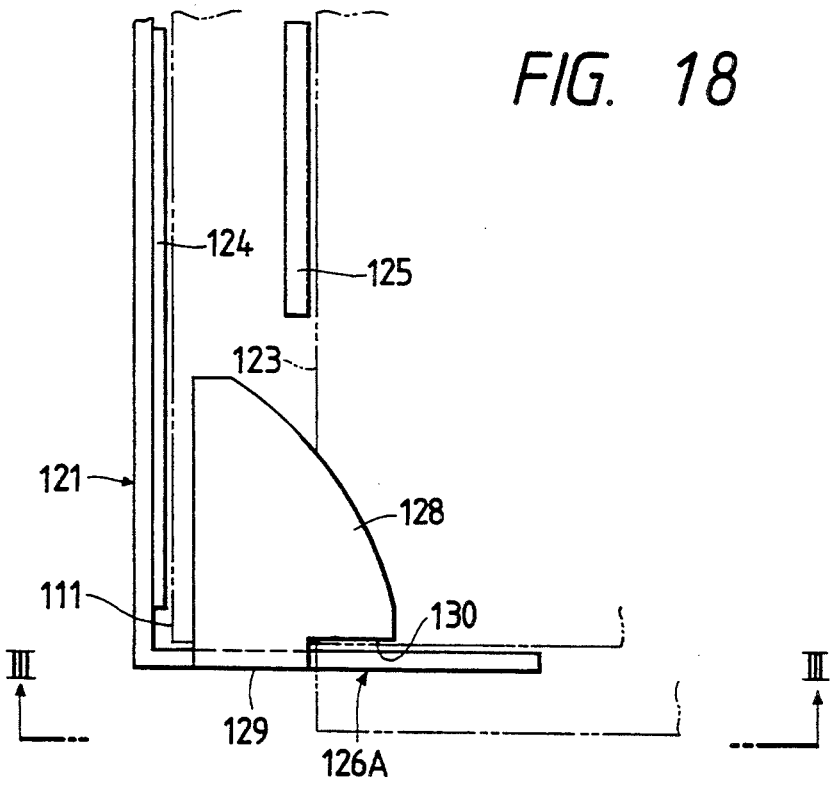
FIG. 18 is a plan view of the separating claw of FIG. 16.
Figure 19:
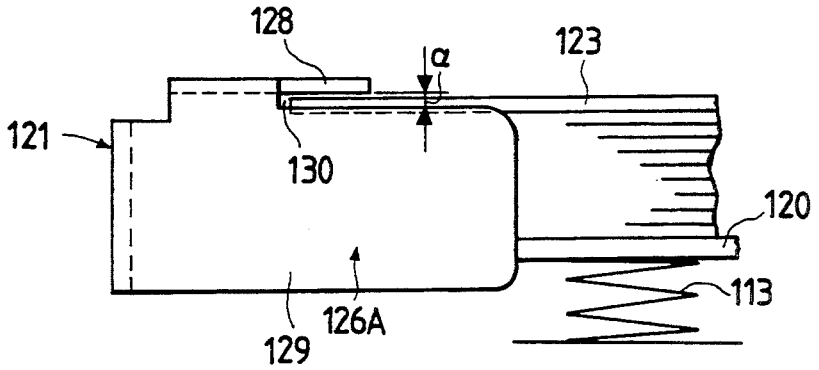
FIG. 19 is a front view of the separating claw looked at along the line III—III of FIG. 18.

In FIGS. 17 and 18, a frame 121 of the sheet feeding apparatus is divided into left and right half frames 121A and 121B, which can be shifted toward and away from each other along a shaft (shaft 122 on which supply rollers are mounted) to adjust the total width of the frame. A number of recording sheets (normal sheets 111 or thicker sheets 123) are stacked on pressure plates 120 arranged within the frame 121, and an upper surface of the sheet stack is pressed upwardly against supply rollers 114 by biasing the pressure plates 120 by means of bias springs 113. Insides of the left and right half frames 121A, 121B, side guides 124 for the normal sheet 111 are provided, and side guides 125 for the thicker sheet 123 are retractably or removably provided on the half frames 121A, 121B or on the pressure plates 120 between the normal sheet guiding side guides 124.

In the embodiment shown in FIGS. 17 and 18, the thicker sheet guiding side guides 125 are arranged on the half frames 121A, 121B or on the pressure plates 120 in cockable fashion, and, when these side guides 125 are laid or flattened as shown in FIG. 17A, they are retracted in the bottom of the pressure plates and the like. On the front ends of the left and right half frames 21A, 121B of the frame 121, separating claws 126A, 126B for separating only an uppermost sheet from the sheet stack are provided, respectively.

The separating claws 126A, 126B as shown are formed integrally with the half frames 121A, 121B, respectively, and each includes a pawl portion 128 and an abutment portion 129. Incidentally, the sheet feeding apparatus shown in FIGS. 17 and 18 is constructed symmetrically with respect to a longitudinal centerline thereof.

Each separating claw 126A, 126B has the portion 128 and the abutment portion 129, and a slit 130 is formed between the pawl portion 128 and the abutment portion 129. The slit 130 extends through about a half of the width of the pawl portion 128, and the distance of the slits 130 are so selected, as shown in FIG. 18, that the thicker sheet 123 guided by the side guides 125 can smoothly pass through the slits.

Figure 16:
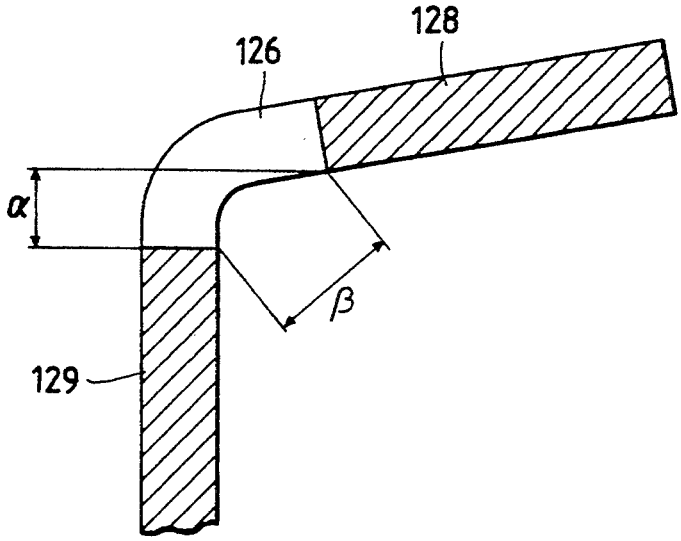
FIG. 16 is a sectional view of a separating claw of a sheet feeding apparatus according to a ninth embodiment of the present invention.

FIG. 16 is a sectional view of the separating claw for explaining the configuration of the slit in the sheet feeding apparatus according to this embodiment. In FIG. 16, the slit is defined by the pawl portion (height limiting member) 128 and the abutment portion (front end limiting member) 129 of the separating claw 126. The slit has a height $\alpha$ and a distance $\beta$ between the pawl portion 128 and the abutment portion 129, the distance $\beta$ being greater than the height $\alpha$. Further, the height $\alpha$ is smaller than a thickness $\gamma$ of the thickner sheet to be automatically fed, and the distance $\beta$ is greater than the thickness $\gamma$ of the thicker sheet.

Figure 31:
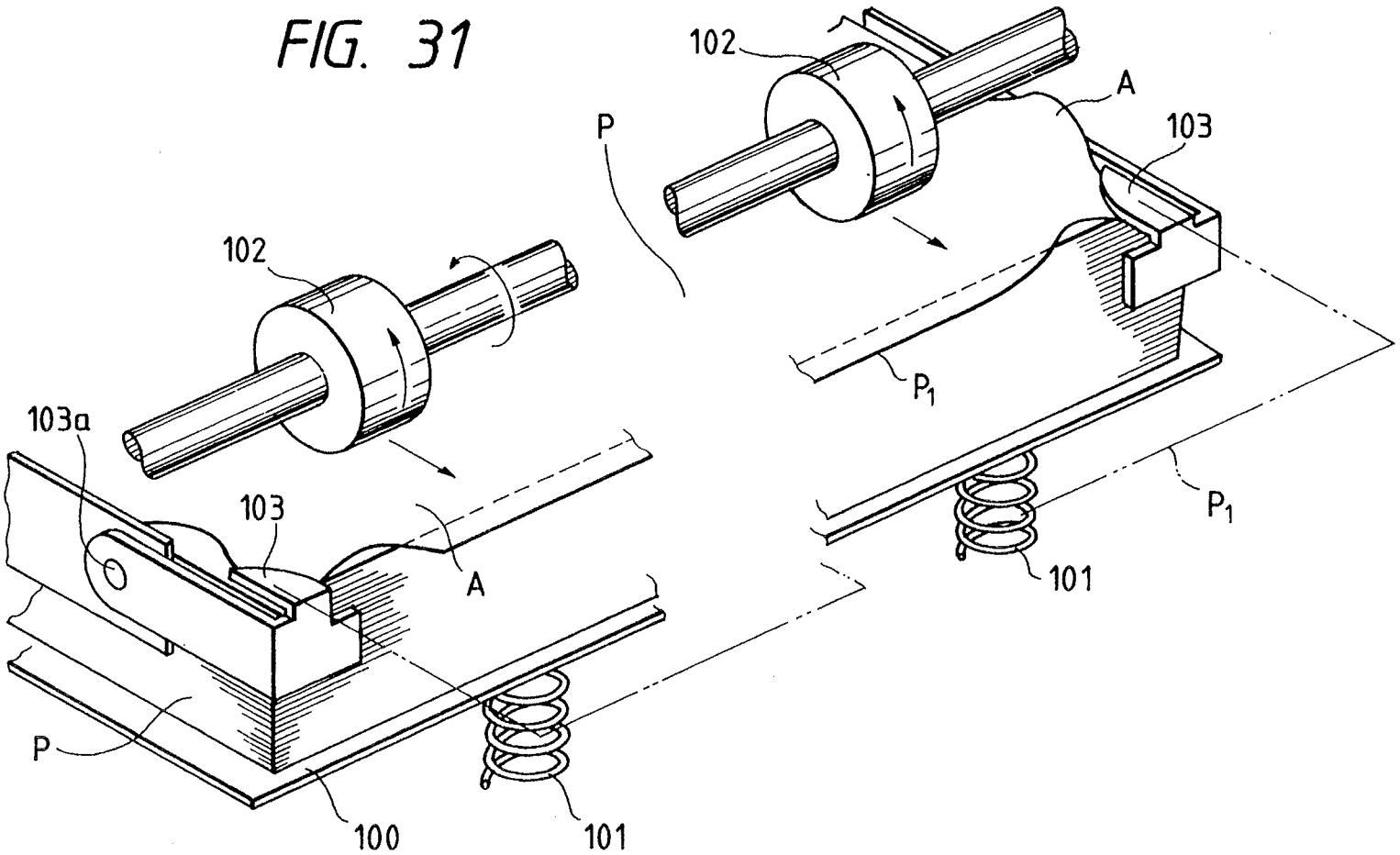
FIG. 31 is a perspective view of a conventional sheet feeding apparatus.

In the sheet feeding apparatus illustrated in FIGS. 16 to 19, when the normal sheet is fed, the inner thicker sheet guiding side guides 125 are removed or retracted not to be used, and the normal sheets 111 are stacked and then the supply rollers 114 are driven. That is to say, in this case, since the front end corners of the normal sheet stack 111 are held down by the pawl portions 128 and the front end of the sheet stack 111 is abutted against the abutment portions 129, the normal sheet 111 can be separated and fed one by one, in the same manner as already described in connection with the conventional sheet feeding apparatus shown in FIG. 31.

On the other hand, when the stacked recording sheets are thicker sheets 123 such as postcards or drawing papers having the higher rigidity, the thicker sheet guiding side guides 125 are cocked or mounted on the frame to be used, and the thicker sheets 123 are set in registration with the side guides 125.

As shown in FIG. 18, the side guides 125 are so arranged with respect to the separating claws that, when the thicker sheets 123 are set, the uppermost sheet is not abutted against the abutment portions 129 and the upper surface of the sheet stack is held down by the pawl portions 128. Now, when the supply rollers 114 are rotated in response to a sheet feed command signal, the uppermost thicker sheet 123 is fed in the sheet feeding direction while being guided at its lateral edges by the side guides 125.

Figure 20:
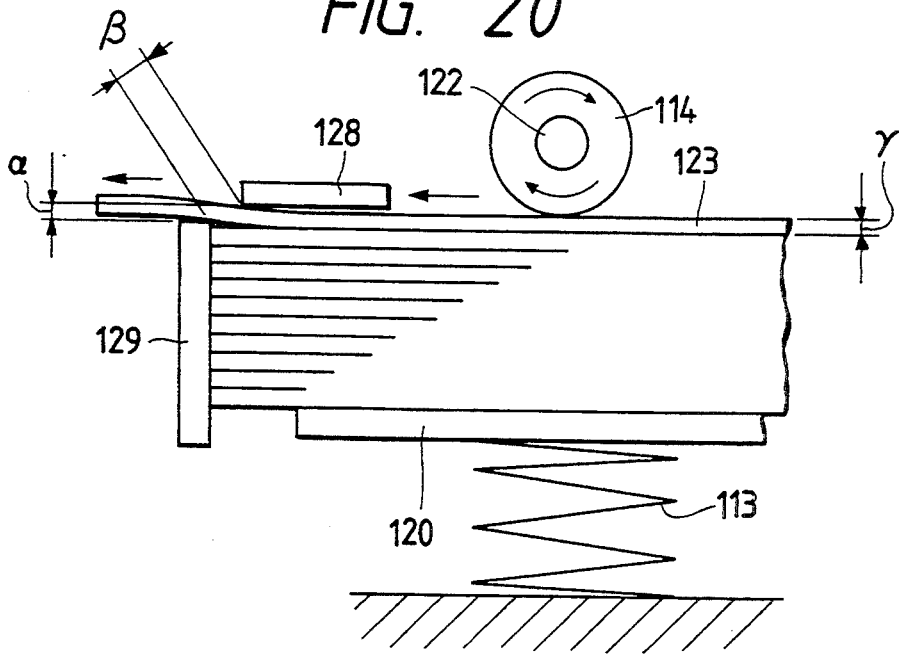
FIG. 20 is a sectional view showing a condition that a thicker sheet is fed.

FIG. 20 is a partial sectional view showing a condition that the thicker sheet 123 is fed by the sheet feeding apparatus shown in FIGS. 16 to 19.

In FIG. 20, when the thicker sheet 123 is fed as mentioned above, the slits having the height $\alpha$ and defined by the pawl portions 128 and the abutment portions 129 are positioned ahead of the thicker sheets. Since the height $\alpha$ is smaller than the thickness $\gamma$ of the thicker sheet 123, the uppermost thicker sheet is contacted with the upper ends of the abutment portions 129. However, since the distance $\beta$ of each slit is greater than the thickness $\gamma$ of the thicker sheet 123, when the supply rollers 114 are further rotated, only the uppermost sheet rides over the abutment portions 129 and is separated from the remaining sheet stack to be fed toward the recording portion and the like.

If the distance $\beta$ is equal to or smaller than the height $\alpha$, the thicker sheet is bent or folded during the separation thereof causing poor feeding; however, in this embodiment of the present invention, such inconvenience does not occur. Further, when the distance $\beta$ is the maximum distance between the pawl portion and the abutment portion and is smaller than twice of the thickness $\gamma$ of the thicker sheet, more reliable separating ability can be obtained.

As mentioned above, since the height $\alpha$ of the slit 130 is smaller than the thickness $\gamma$ of the thicker sheet and the distance $\beta$ of the slit is greater than the thickness $\gamma$ of the thicker sheet, the thicker sheet 123 can be positively separated without double-feeding of the sheets. In this way, by using only one kind of separating claws 126A, 126B, both of the normal sheet 111 and the thicker sheet 123 can be positively separated and fed with a simple arrangement.

Figure 21:
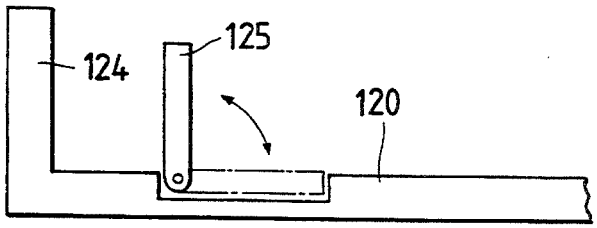
FIG. 21 is a side view of a side guide for a thicker sheet.

In FIG. 21 showing a schematic sectional view of the side guides 124, 125 shown in FIG. 17, the thicker sheet guiding side guide 125 is cockably or retractably mounted on the pressure plate 120.

When the normal sheets 111 are fed, the side guides 125 are retracted or laid in the pressure plates 120 to be flush with the latter as shown by the dot and chain line, and the normal sheets 111 are set so that the lateral edges thereof are guided by the outer side guides 124. When the thicker sheets 123 such as postcards having the higher rigidity are fed, the side guides 125 are cocked as shown by the solid line to be used.

Next, a tenth embodiment of the present invention will be explained.

Figure 22:
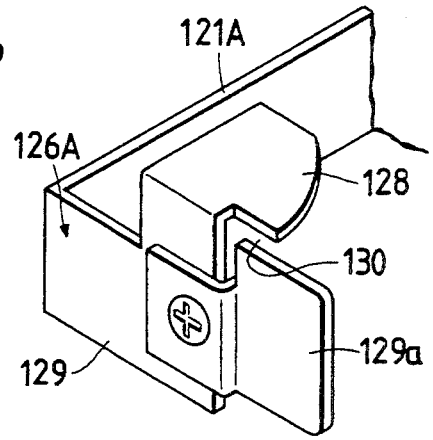
FIG. 22 is a perspective view of a separating claw of a sheet feeding apparatus according to a tenth embodiment of the present invention.

FIG. 22 shows an alteration of the separating claw 126A, 126B as a perspective view. In this separating claw, an inner portion 129*a* defining the lower edge of the slit 130 is formed separately from the body of the claw, and the separating claw is assembled by removably attaching the inner portion 129*a* to the body of the claw by a screw and the like.

With this arrangement, the accuracy of the dimension of the slit 130 which is difficult to obtain by making the claw with a single piece by stamping and bending operation can be easily improved by making the claw with two pieces and by assembling these two pieces to keep the slit dimension with high accuracy. Further, by merely changing the shape of the inner portion 129*a*, the dimension of the slit can easily be changed to meet with the sheets having different thicknesses.

Next, an eleventh embodiment of the present invention will be explained.

Figure 23:
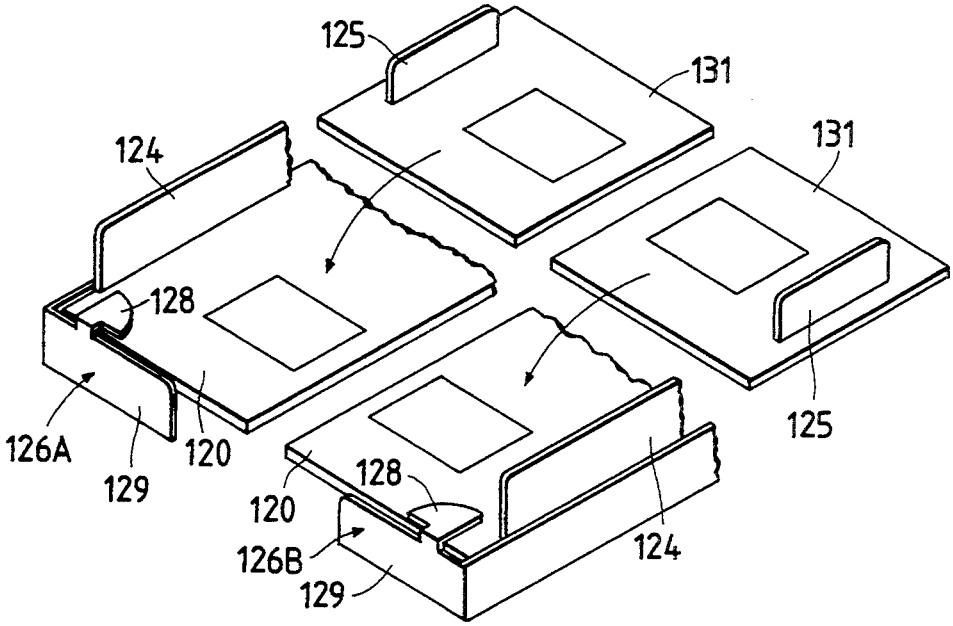
FIG. 23 is a perspective view of side guides of a sheet feeding apparatus according to an eleventh embodiment of the present invention.

FIG. 23 is an exploded perspective view of the sheet feeding apparatus wherein the side guides 125 for the thicker sheet 123 are removably mounted.

In FIG. 23, pressure plates 131 on which the thicker sheets 123 are stacked are provided independently of the pressure plates 120 on which the normal sheets 111 are stacked, and the thicker sheet guiding side guides 125 are fixedly mounted on the respective pressure plates 131. When the normal sheets 111 are used, the pressure plates 131 are removed from the sheet feeding apparatus, whereas, when the thicker sheets 123 are used, the pressure plates 131 with the side guides 125 are attached onto the corresponding pressure plates 120 in place.

Figure 24:
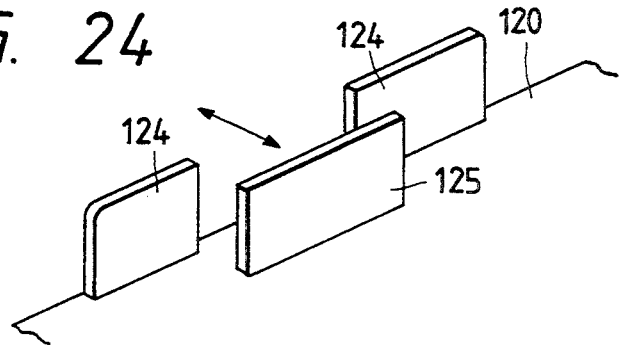
FIG. 24 is a perspective view of a side guide of slidable type.

FIG. 24 shows an alteration of the thicker sheet guiding side guide 125, wherein the normal sheet guiding side guide 124 formed on the outer lateral edge of the corresponding pressure plate 120 is so designed that a portion 125 of the side guide 124 can be slid by a predetermined distance in the transverse direction of the side guide. When the thicker sheets 123 are used, as shown in FIG. 24, the slidable portion 125 is slidably shifted inwardly to form the thicker sheet guiding side guide 125, whereas, when the normal sheets 111 are used, the slidable portion is retracted to cooperate with the remaining portions of the side guide 124, thereby completing the whole normal sheet guiding side guide 124.

Incidentally, in FIG. 22, if the separate portion 129*a* of the abutment portion 129 can be adjusted in an up-and-down direction by an operator, it is possible to adjust the width h of the slit 130 defined between the separate portion 129*a* and the pawl portion 128, thus permitting the use of the sheets having the different thickness.

As apparent from the foregoing explanation, in the sheet feeding apparatus having the separating claw mechanisms, by providing the left and right separating each including the slit having the height smaller than the thickness of the thicker sheet and the distance larger than the thickness of the thicker sheet and by removably or retractably providing the thicker sheet guiding side guides for guiding the lateral edges of the thicker sheet stack, both of the normal sheet and the thicker sheet can be separated and fed by using only one kind of separating claws, and, accordingly, the sheets having the different thickness (rigidity) can easily be separated with a simple construction, and the thicker sheet can be separated more positively.

Figure 25:
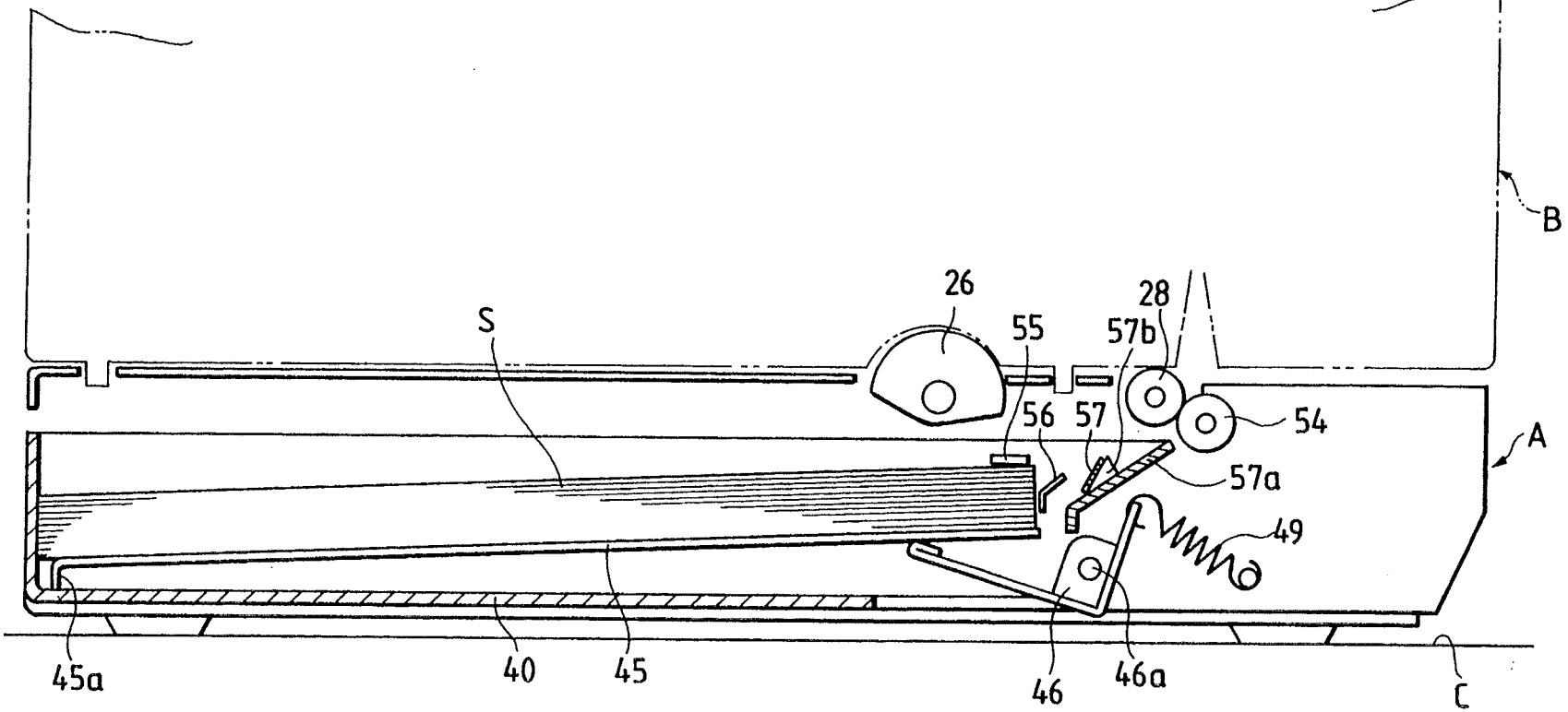
FIG. 25 is an elevational sectional view of a sheet feeding apparatus according to a twelveth embodiment of the present invention.

Next, a twelveth embodiment of the present invention will be explained with reference to FIGS. 25 to 27.

In this twelveth embodiment, the double-feed preventing pad shown in the sixth to eighth embodiments (FIGS. 13 to 15) is shiftable.

Figure 26A:
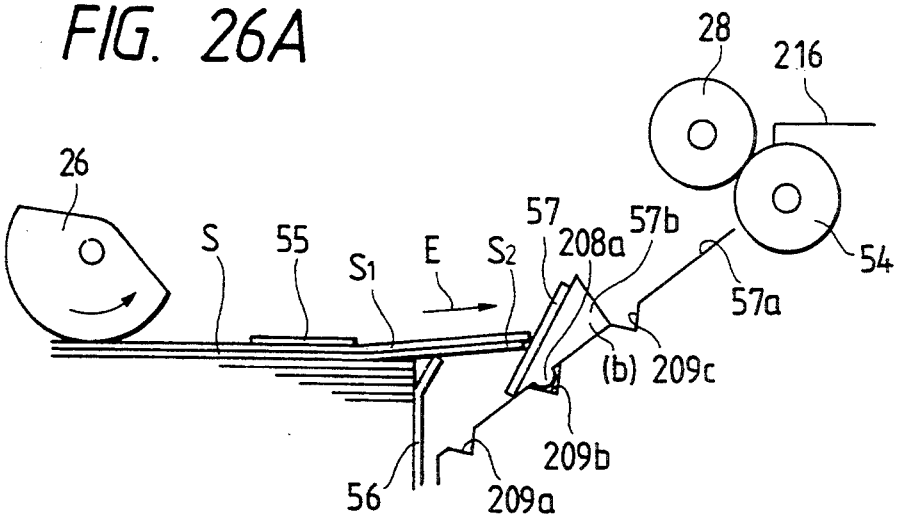
FIGS. 26A, 26B and 26C are explanatory views showing processes that only a single sheet is separated from other sheets by the sheet feeding apparatus of FIG. 25.
Figure 26B:
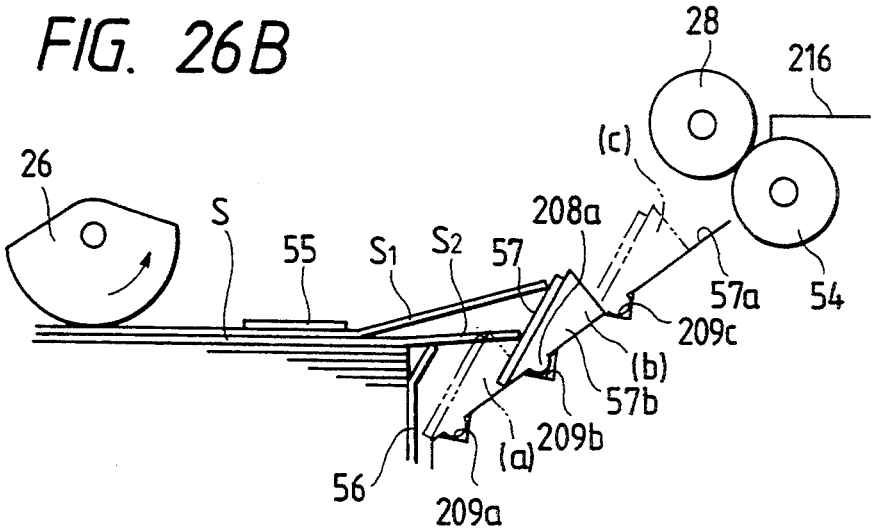
Figure 26C:
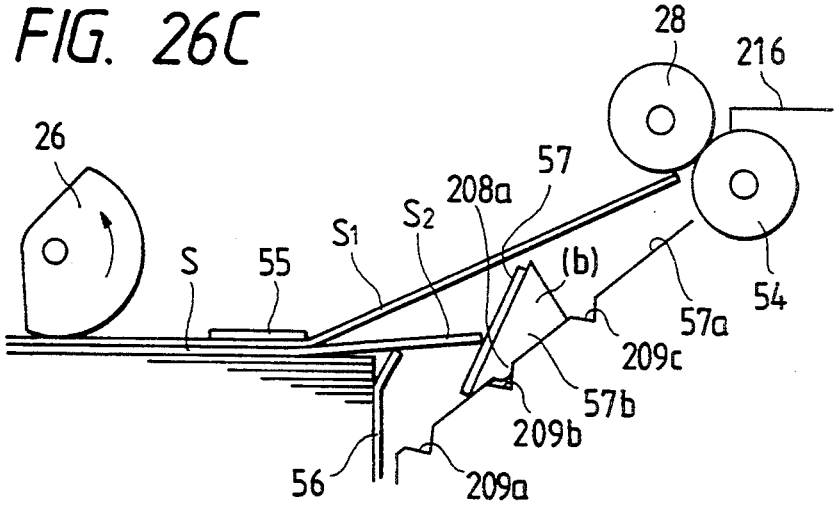
Figure 27:
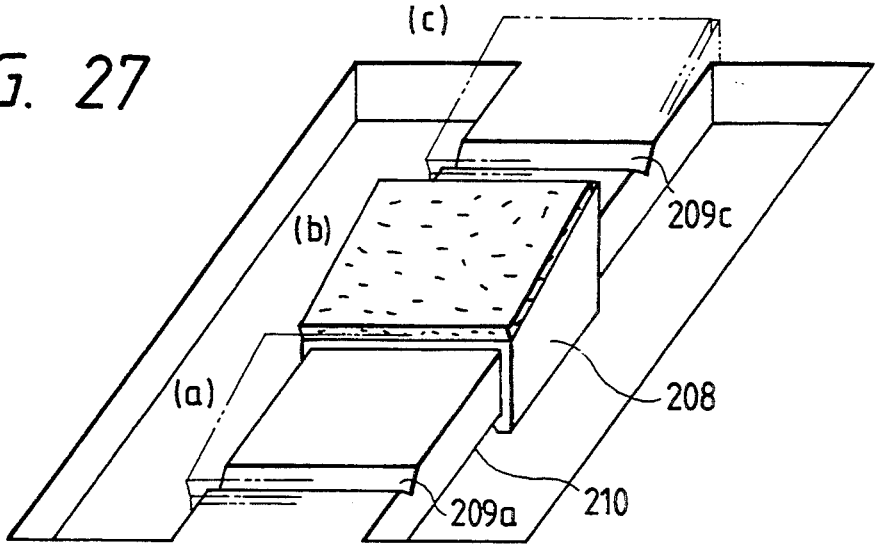
FIG. 27 is a perspective view of a double-feed preventing pad.

As shown in FIG. 26, in relation with the double-feed preventing pad 57, three recesses 209*a*, 209*b* and 209*c* are formed in an inclined front wall 57*a* of the sheet cassette 40, and, as shown in FIG. 27, guides 210 are arranged on both sides of these recesses 209*a*, 209*b*, 209*c*. The double-feed preventing pad 57 is guided on and along these guides 210, and a projection 208*a* formed on the bottom of a base 57*b* of the double-feed preventing pad 57 is locked in one of the recesses 209*a*, 209*b*, 209*c*. Incidentally, the double-feeding preventing pad 57 may be removable to change its position.

According to this embodiment, with the arrangement mentioned above, when the supply rollers 26 are rotated, the sheet S is shifted in a direction shown by the arrow E. If the next sheet $S_2$ is moved together with the uppermost sheet $S_1$, since the uppermost sheet $S_1$ is driven by the supply rollers 26 having the larger coefficient of friction than that of the double-feed preventing pad 57, it can ride over the double-feed preventing pad 57 and is fed to the nip between the feeding rollers 28, 54, as shown in FIG. 26C. However, since the next sheet $S_2$ is driven by the coefficient of friction between the sheets smaller than the coefficient of friction of the pad 57, this sheet is blocked by the friction between the sheet and the pad. That is to say, only the uppermost sheet $S_1$ can be separated and be fed to the feeding rollers 28, 54, and is then introduced into the printer by the feeding rollers 28, 54.

In this case, when the sheets which are apt to cause the double-feeding are used, the double-feed preventing pad 57 is set to a position (c) where the sheet must be shifted along the longest distance on the pad to ride over the latter; whereas, when the sheets which are apt to cause the poor feeding because they are difficult to ride over the double-feed preventing pad 57 due to the fact that the sheet is too thick or too hard to be bent are used, the double-feed preventing pad 57 is set to a position (a) where the sheet may be shifted along the shortest distance on the pad to ride over the latter.

Further, as the amount of the sheets in the cassette 40 is reduced, the sheet stack is gradually lifted by the intermediate plate 45 to press the upper surface of the sheet stack S against the height limiting members 55, thus keeping the upper surface of the sheet stack in a substantially constant level, thereby stabilizing the separation and feeding of the sheet S all the time.

Figure 28A:
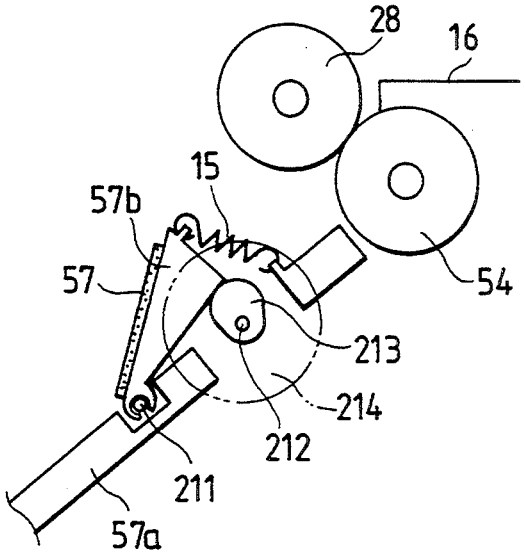
FIG. 28A is a side view of a main portion of a sheet feeding apparatus according to a thirteenth embodiment of the present invention.
Figure 28B:
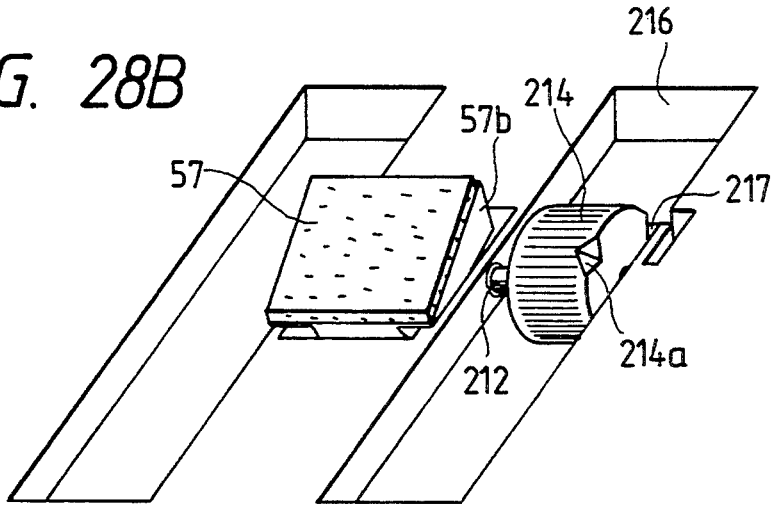
FIG. 28B is a perspective view of the apparatus of FIG. 28A.

Next, a thirteenth embodiment of the present invention will be explained with reference to FIGS. 28A and 28B.

In this embodiment, the double-feed preventing pad 57 is pivotably mounted on the inclined front wall 57*a* of the cassette 40 at 211 and is adapted to be driven by an eccentric cam 213 rotated around the shaft 212. The pad 57 is always pressed against the cam 213 by a bias spring 215. Accordingly, the pad 57 can be pivotted by the cam against the bias force of the spring. Further, a dial 214 is attached to the cam shaft 212, and a plurality of recesses 214*a* are formed in the dial 214. By engaging a spring-biased projection 217 arranged on the frame of the apparatus into one of the recesses 214*a* of the dial 214, the inclined angle of the double-feed preventing pad 57 can be adjusted at a multi-stages. In this way, by changing the inclined angle of the double-feed preventing pad 57, the resistance that the sheet rides over the pad can be adjusted.

When the thinner sheets which are apt to cause the double-feeding are used, the inclination angle of the pad 57 is increased to increase the resistance, thereby preventing the double-feeding of the sheets. On the other hand, when the sheets S which are apt to cause the poor feeding because they are difficult to ride over the double-feed preventing pad 57 are used, the inclination angle of the pad 57 is decreased to reduce the resistance.

Figure 29:
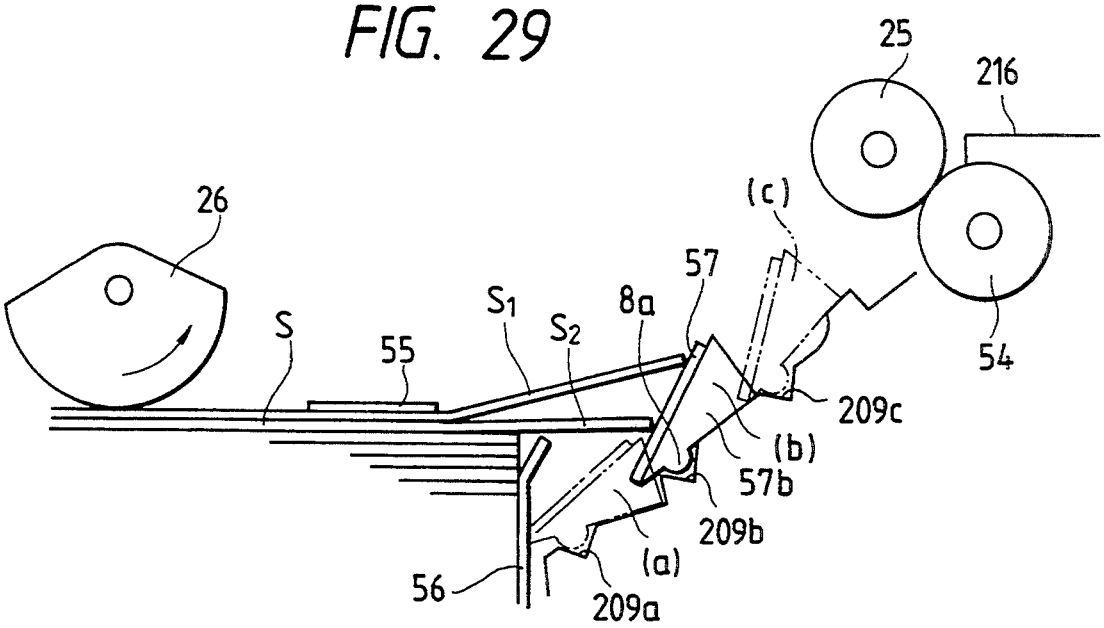
FIG. 29 is a side view showing an alteration of the sheet feeding apparatus.

Next, an alteration will be explained with reference to FIG. 29.

The double-feed preventing pad 57 can be set in one of the positions (a), (b), (c). In this case, the inclination of the surface (on which the pad 57 is set) relating to the position (a) is smaller than the inclination of the surface relating to the position (b), and the inclination of the surface relating to the position (b) is smaller than that of the position (c). Accordingly, when the sheets S which are apt to cause the poor feeding because they are difficult to ride over the double-feed preventing pad 57 are used, the pad 57 is set in the position (a), whereas, when the thinner sheets S which are apt to cause the double-feeding are used, the pad is set in the position (c). In this way, the condition of separation of the sheets can be extended.

Incidentally, the double-feed preventing pad 57 shown in FIG. 28 may be shifted to control the shifting distance of the sheet on the pad independently of the inclination of the pad.

Figure 30:
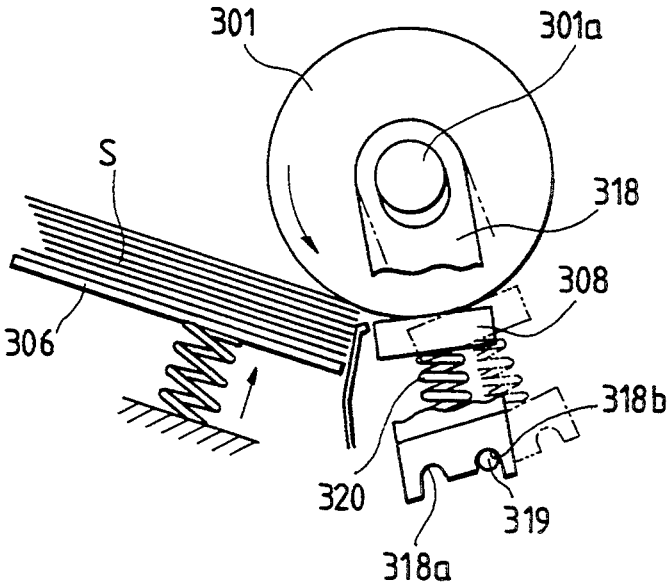
FIG. 30 is a side view of a main portion of a sheet feeding apparatus according to a fourteenth embodiment of the present invention.

Next, a fourteenth embodiment of the present invention will be explained with reference to FIG. 30.

According to this embodiment, supply rollers 301 are urged against a separating pad 308.

A cradle 318 is supported from a shaft 301*a* on which the supply rollers 301 are mounted, and a separating pad 308 is rested on the cradle 318 through a compression spring 320, and thus, the separating pad 308 is urged against the supply rollers 301. Further, a lock pin 319 is formed on the apparatus and a plurality of recesses 318*a* are formed in the bottom of the cradle 318. One of the recesses can be engaged by the lock pin.

With this arrangement, if the lock pin 319 is received in the recess 318*b*, an angle between the fed sheet S and the separating pad 308 will be smaller, whereas, if the lock pin 319 is received in the recess 318*a*, the angle between the fed sheet S and the separating pad 308 will be larger.

When the thinner sheets which are apt to cause the double-feeding are used, the angle between the fed sheet and the separating pad is set to have a larger value, whereas, when the thicker sheets which are apt to cause the poor feeding are used, such angle is set to have a smaller value.

In this way, the troubles caused by the thicker sheet and the thinner sheet can be effectively eliminated.

According to twelveth to fourteenth embodiments, since the double-feed preventing pad 57 can be set in one of plural positions in the inclined sheet feeding path 57*a*, the distance that the sheet rides over the double-feed preventing pad 57. Accordingly, by selecting the shorter distance for the thicker sheets such as postcards, library cards or the like which are apt to cause the poor feeding because they are difficult to ride over the pad and by selecting the longer distance for the thinner sheets which are apt to cause the double-feeding, various kinds of sheets can be smoothly separated and fed. Further, even for the sheets such as envelopes which are folded and have different volumes in accordance with the circumferential conditions, since the distance that the sheet must ride over the double-feed preventing pad 57 can be changed in accordance with the circumferential conditions, such envelope can also be smoothly separated and fed. Further, since the construction for permitting the change in position of the double-feed preventing pad 57 is simple, the manufacturing cost can be reduced.

In addition, since the inclination angle of the double-feed preventing pad 57 can be changed, the resistance that the sheet is fed in the feeding path 57*a* can be changed in accordance with the feeding angle of the sheet, the surface condition of the sheet or the double-feed preventing pad and/or the thickness of the sheet, thus stabilizing the feeding speed of the sheet, thereby separating and feeding the sheet smoothly in combination with the adjustment of the riding distance.

Further, since the double-feed preventing pad 57 can be removable, the worn pad can be easily replaced to restore the desired condition quickly and to extend the service life of the apparatus.

Further, by utilizing the gate means between the height limiting member 55 and the front end limiting member 56, and the double-feed preventing pad 57, the ability of separation and feeding of the sheet can be remarkably improved.

What is claimed is:

1. A sheet feeding apparatus comprising:

sheet supporting means disposed in a lower position of the sheet feeding apparatus for supporting a sheet stack;

supply means contacting a surface of a sheet on the sheet stack, for feeding out the sheet;

first limiting means contacting a front edge of the sheet stack on said sheet supporting means;

second limiting means contacting the sheet surface contacted by said supply means, said first and second limiting means defining a clearance of a predetermined length in the sheet feeding direction therebetween, said first and second limiting means separating the sheets one by one by causing the sheet to pass over said first limiting means and through the clearance;

convey means arranged downstream of said first limiting means for conveying the sheet fed out by said supply means upwardly; and friction means arranged between said first limiting means and said convey means for separating sheet which has not been separated by said first and second limiting means, said friction means changing a feeding orientation of the sheet to be separated to feed it to said convey means.

2. A sheet feeding apparatus according to claim 1 wherein the clearance has a predetermined length to allow bending of the sheet in the sheet feeding direction, the length being smaller than a thickness of one sheet.

3. A sheet feeding apparatus according to claim 2, wherein a distance between an upper end of said first limiting means and a forward end of said second limiting means is larger than the thickness of one sheet.

4. A sheet feeding apparatus according to claim 2, wherein said second limiting means contacts an uppermost sheet in the sheet stack.

5. A sheet feeding apparatus according to claim 1,,wherein said second limiting means contacts an uppermost sheet in the sheet stack.

6. A sheet feeding apparatus according to claim 1, wherein said second limiting means contacts said sheet at a position rearwardly of the front edge of the sheet stack.

7. A sheet feeding apparatus according to claim 1, wherein said first limiting means has an inclined portion inclined upwardly toward the sheet feeding direction.

8. A sheet feeding apparatus according to claim 1, wherein said friction means comprises a friction pad and separates the sheets by contacting the front end of the sheet.

9. A sheet feeding apparatus according to claim 1, further including an urging means for urging the front end of said sheet against said friction pad.

10. A sheet feeding apparatus according to claim 1, wherein said friction pad can be changed in its position.

11. A sheet feeding apparatus according to claim 10, wherein said friction pad can be changed in its position along the sheet feeding direction.

12. An image forming apparatus comprising:

sheet supporting means disposed in a lower position of the image forming apparatus for supporting a sheet stack;

supply means contacting a surface of a sheet oil the sheet stack, for feeding out the sheet;

first limiting means contacting a front edge of the sheet stack on said sheet supporting means;

second limiting means contacting the sheet surface contracted by said supply means, said first and second limiting means defining a clearance of a predetermined length in the sheet feeding direction therebetween, said first and second limiting means separating the sheets one by one by causing the sheet to pass over said first limiting means and through the clearance;

image forming means disposed at an upper position of said image forming apparatus for forming the image on the sheet separated by said first limiting means and said second limiting means;

convey means arranged downstream of said first limiting means for conveying the sheet fed out by said supply means upwardly to said image forming means; and friction means arranged between said first limiting means and said convey means for separating the sheet which has not been separated by said first limiting means and said second limiting means, said friction means changing feeding orientation of the sheet to be separated to feed it to said convey means.

13. A sheet feeding apparatus, comprising:

sheet accommodation means for accommodating a stack of sheets, said sheet accommodation means removably insertable into said sheet feeding apparatus;

supply means contacting a surface of a sheet on the sheet stack accommodated in said accommodation means for feeding out the sheet in a feeding position;

first limiting means contacting a front edge of the sheet stack on said sheet supporting means; and second limiting means contacting the sheet surface contacted by said supply means said first and second limiting means defining a clearance of a predetermined length in the sheet feeding direction therebetween, said second limiting means separating the sheets one by one by causing the sheets to pass over said first limiting means and to pass through the clearance;

moving means for moving the sheets accommodated in said sheet accommodating means to the feeding position in response to the insertion of said accommodating means into said sheet feeding apparatus; and abut means for causing said second limiting means to abut the sheets when the sheets are located at the feeding position but not to abut the sheets when the sheets are not located at the feeding position.

14. A sheet feeding apparatus according to claim 13, wherein the predetermined length of the clearance allows bending of the sheet in the sheet feeding direction, the length being smaller than thickness of one sheet in a thickness direction.

15. A sheet feeding apparatus according to claim 13, wherein said first limiting means and said second limiting means are integrally provided and rockably supported along a side edge of the sheet stack.

16. A sheet feeding apparatus according to claim 13, further comprising friction separating means disposed downstream of said first limiting means for separating a sheet which has not been separated by said first limiting means and said second limiting means.

17. An image forming apparatus comprising:

sheet accommodation means for accommodating a stack of sheets, said sheet accommodating means removably insertable into said sheet feeding apparatus;

supply means contacting a surface of a sheet on the sheet stack, for applying a feeding force to said sheet;

first limiting means contacting a front edge of the sheet stack on said sheet accommodating means;

second limiting means contacting the sheet surface contacted by said supply means, said first and second limiting means defining a clearance of a predetermined length in the sheet feeding direction therebetween, said first limiting means and said second limiting means separating the sheets one by one by causing the sheet to pass over said first limiting means and to pass through the clearance;

an image forming means for forming an image on the sheet separated by said first limiting means and said second limiting means;

moving means for moving the sheets accommodated in said sheet accommodating means to the feeding position in response to insertion of said accommodating means into said sheet feeding apparatus; and abut means for causing said second limiting means to abut onto the sheets by its own gravity when the sheets are located at the feeding position, but not to abut the sheets when the sheets are not located at the feeding position.

18. A sheet feeding apparatus according to claim 17, wherein said supply means has a roller a part of an outer periphery of which is cut out.

19. A sheet feeding apparatus comprising:

sheet supporting means for supporting a sheet stack;

supply means contacting a surface of a sheet on the sheet stack for feeding out the sheet;

separating means for separating the sheets fed out by said supply means one by one, said separating means comprising a first limiting portion contacting a front edge of the sheet stack on said sheet supporting means and a second limiting portion contacting the sheet surface contacted by said supply means, said first limiting portion and said second limiting portion defining a clearance of a predetermined length in the sheet feeding direction therebetween, said first limiting portion and said second limiting portion separating the sheets one by one by causing the sheets to pass-over said first limiting portion and to pass through the clearance; and holding means pivotably holding said separating means to cause said second limiting portion to abut onto the sheet stack by gravitation force of said separating means.

20. A sheet feeding apparatus according to claim 19, wherein said sheet supporting means comprises a sheet supporting plate which is pivotably mounted for supporting the sheet stack and biasing means for biasing said sheet supporting plate toward said supply means, and wherein said second limiting portion contacts an uppermost sheet in the sheet stack supported on said sheet supporting plate.

21. A sheet feeding apparatus according to claim 19, wherein said separating means is rockably supported along a side edge of the sheet stack supported by said sheet supporting means.

22. A sheet feeding apparatus according to claim 19, wherein said first limiting portion and said second limiting portion are integrally provided.

23. A sheet feeding apparatus according to claim 19, further comprising friction separating means disposed downstream of said first limiting portion for separating the sheet which has not been separated by said first limiting portion and said second limiting portion.

24. An image forming apparatus comprising:

sheet supporting means for supporting a sheet stack;

supply means contacting with a surface of a sheet on the sheet stack for feeding out the sheet;

separating means for separating one by one the sheets fed out by said supply means, wherein said separating means comprises:

a first limiting portion contacting an edge of the sheet stack on said sheet supporting means; and a second limiting portion contacting the sheet surface contacted by said supply means, said first limiting portion and said second limiting portion defining a clearance of a predetermined length in the sheet feeding direction therebetween, and said first and second limiting portions separating the sheets one by one by causing the sheets to pass over the first limiting means and to pass through the clearance;

holding means for pivotably holding said separating means so that said second limiting portion abuts onto the sheet stack by gravitational force of said separating means; and image forming means for forming the image on the sheet separated by said separating means, portion.

* * * * *

UNITED STATES PATENT AND TRADEMARK OFFICE

CERTIFICATE OF CORRECTION

PATENT NO. : 5,443,251

DATED : August 22, 1995

INVENTOR(S) : SHOICHI KAN, ET AL.

It is certified that error appears in the above-indentified patent and that said Letters Patent is hereby corrected as shown below:

Column 2,
line 35, "nave" should read --have--.

Column 3,
line 53, "clearance B" should read --clearance ß--; and
line 56, "even sheet" should read --even sheets--.

Column 4,
line 15, "to" should read --to a--; and
line 36, "or the" should read --in the--.

Column 6,
line 7, "clearance B" should read --clearance ß--;
line 47, "bent" should read --bend--; and
line 62, "frown" should read --from--.

Column 9,
line 13, "slide" should read --slid--.

Column 13,
line 9, "in" should read --is--.

Column 15,
line 52, "noticeably" should read --noticeable--; and
line 54, "after" should be deleted.

Column 16,
line 56, "frames 21A," should read --frames 121A,--.

UNITED STATES PATENT AND TRADEMARK OFFICE

CERTIFICATE OF CORRECTION

PATENT NO. : 5,443,251

DATED : August 22, 1995

INVENTOR(S) : SHOICHI KAN, ET AL.

It is certified that error appears in the above-indentified patent and that said Letters Patent is hereby corrected as shown below:

Column 17,
line 16, "thickner" should read --thicker--.
Column 19,
line 25, "twelveth" should read --twelfth--; and
line 27, "twelveth" should read --twelfth--.
Column 20,
line 23, "a" should be deleted.
Column 21,
line 13, "twelveth" should read --twelfth--.
Column 22,
line 5, "sheet" should read --a sheet--;
line 48, "oil" should read --on--; and
line 53, "contracted" should read --contacted--.
Column 24,
line 31, "pass-over" should read --pass over--; and
line 36, "gravitation" should read --the gravitational--.
Column 26,
line 2, "gravitational" should read --a gravitational--; and
line 5, "means, portion." should read --means.--.

Signed and Sealed this

Twelfth Day of March, 1996

Bruce Lehman

*Attest:*

BRUCE LEHMAN

*Attesting Officer*

*Commissioner of Patents and Trademarks*